US011125218B2

(12) United States Patent
Botting et al.

(10) Patent No.: US 11,125,218 B2
(45) Date of Patent: Sep. 21, 2021

(54) MODULAR HORIZONTAL PUMPING SYSTEM WITH MOBILE PLATFORM AND METHOD OF USING SAME

(71) Applicant: Odessa Pumps and Equipment, Inc., Houston, TX (US)

(72) Inventors: Donald Ray Botting, Magnolia, TX (US); Justin Sterling Byerly, Katy, TX (US)

(73) Assignee: Odessa Pumps and Equipment, Inc., Houston, TX (US)

( * ) Notice: Subject to any disclaimer, the term of this patent is extended or adjusted under 35 U.S.C. 154(b) by 0 days.

(21) Appl. No.: 16/276,349

(22) Filed: Feb. 14, 2019

(65) Prior Publication Data

US 2019/0257297 A1 Aug. 22, 2019

Related U.S. Application Data

(60) Provisional application No. 62/631,621, filed on Feb. 16, 2018.

(51) Int. Cl.

| | |
|---|---|
| ***F04B 17/06*** | (2006.01) |
| ***E21B 43/26*** | (2006.01) |
| ***F04B 17/03*** | (2006.01) |
| ***F04D 1/00*** | (2006.01) |
| ***F04B 47/02*** | (2006.01) |

(52) U.S. Cl.

CPC ..... *F04B 17/06* (2013.01); *E21B 43/26* (2013.01); *F04B 17/03* (2013.01); *F04B 47/02* (2013.01); *F04D 1/00* (2013.01)

(58) Field of Classification Search

CPC ..... F04B 47/02; F04D 1/00; E21B 43/26
USPC ..... 166/75.11
See application file for complete search history.

(56) References Cited

U.S. PATENT DOCUMENTS

| | | | |
|---|---|---|---|
| 5,957,656 | A | 9/1999 | Long |
| 6,461,115 | B1 | 10/2002 | Ferrier et al. |
| 8,016,571 | B2 | 9/2011 | Speer et al. |
| 8,246,251 | B1 | 8/2012 | Gardner |
| 8,529,222 | B2 | 9/2013 | Burns et al. |

(Continued)

OTHER PUBLICATIONS

GR Energy Services, FLEX FLOW Horizontal Pumping System for Saltwater Disposal, Jan. 14, 2016, pp. 1-2.

(Continued)

*Primary Examiner* — Matthew R Buck
*Assistant Examiner* — Patrick F Lambe
(74) *Attorney, Agent, or Firm* — Jonathan Pierce; Pierre Campanac; Porter Hedges LLP

(57) ABSTRACT

A modular horizontal pumping unit, system, and method for pumping fluid at a wellsite. The modular horizontal pumping unit includes a pump assembly comprising a motor and a pump; fluid connectors to fluidly connect the pump assembly to wellsite equipment to pass fluid therebetween during a pumping operation; and a mobile platform transportable to a wellsite. The mobile platform includes a chassis and a wheel assembly. The chassis includes a frame with saddles. The frame has a torque bar extending through the frame to prevent deflection. The frame carried by the wheel assembly. The saddles are positioned about the frame to support the pump assembly in an operational position thereon during transport of the pump assembly and during the pumping operation at the wellsite.

31 Claims, 22 Drawing Sheets

(56) References Cited

U.S. PATENT DOCUMENTS

| | | | | |
|---|---|---|---|---|
| 9,534,603 | B2 | 1/2017 | John et al. | |
| 2006/0260331 | A1* | 11/2006 | Andreychuk | F04B 17/06 62/50.2 |
| 2006/0269178 | A1 | 11/2006 | Mascola | |
| 2007/0086906 | A1 | 4/2007 | Horley et al. | |
| 2010/0284830 | A1 | 11/2010 | Burns et al. | |
| 2015/0030470 | A1 | 1/2015 | Ortega et al. | |
| 2015/0093266 | A1 | 4/2015 | Nelson et al. | |

OTHER PUBLICATIONS

GR Energy Services, FLEX FLOW Horizontal Pumping System for Saltwater Disposal, Oct. 8, 2016, pp. 1-2.

* cited by examiner

MODULAR HORIZONTAL PUMPING SYSTEM WITH MOBILE PLATFORM AND METHOD OF USING SAME

CROSS-REFERENCE TO RELATED APPLICATIONS

This application claims the benefit of U.S. Patent Application No. 62/631,621 filed on Feb. 16, 2018, the entire contents of which is hereby incorporated by reference herein.

BACKGROUND

The present disclosure relates generally to oilfield technology. More specifically, the present disclosure relates to devices for pumping fluids at a wellsite.

Pumps are used at a wellsite to pump fluids used in oilfield operations. For example, drilling fluids are pumped into the wellbore during drilling to line the wellbore and facilitate removal of cuttings. Once drilled, casing is positioned into the wellbore and cement is pumped into the wellbore to secure the casing in position. Once completed, treatment fluids are pumped into the wellbore to fracture the formation and facilitate production. Disposal fluids are also pumped into the wellbore for storage therein.

Pumps are typically delivered to wellsites via truck. The pumps may be transported to the wellsite and installed for use at the wellsite. For example, the pump may be secured onto a permanent pad at the wellsite. Examples of pumps that are used at wellsites are provided in U.S. Patent/Application Nos. 20150093266, 20150030470, 20100284830, 20070086906, 20060269178, U.S. Pat. Nos. 9,534,603, 8,529,222, 8,246,251, 8,016,571, 6,461,115, and 5,957,656, the entire contents of which are hereby incorporated by reference herein.

Despite the advancements in pumping system technology, there remains a need to quickly and efficiently deploy pumps to desired locations. The present disclosure is directed at providing such needs.

SUMMARY

In at least one aspect, the disclosure relates to a modular horizontal pumping unit for pumping fluid at a wellsite. The modular horizontal pumping unit comprises a pump assembly comprising a motor and a pump; fluid connectors to fluidly connect the pump assembly to wellsite equipment to pass fluid therebetween during a pumping operation; and a mobile platform transportable to a wellsite. The mobile platform comprises a chassis and a wheel assembly. The chassis comprises a frame with saddles, the frame having a torque bar extending through the frame to prevent deflection. The frame is carried by the wheel assembly. The saddles are positioned about the frame to support the pump assembly in an operational position thereon during transport of the pump assembly and during the pumping operation at the wellsite.

The saddles comprise a base and a receptacle. The receptacle comprises a ring receptacle or an open receptacle. The chassis has saddle plates supported on the frame, the saddles secured to the saddle plates.

The modular horizontal pumping unit may further comprise an operation station carried by the chassis, the operation station comprising electronics to drive the motor. The operation station comprises a housing with the electronics therein and a control panel coupled to the electronics, the control panel oriented for operator line of site. The operation station comprises a vertical housing and a support arm, the support arm defining a cover extending between the housing and the platform. The wheel assembly is a modular assembly removably attached to the chassis.

The modular horizontal pumping unit may further comprise jacks extendable from the chassis to lift the chassis above a ground surface at the wellsite, a skid removably connectable to the chassis, the pump assembly supported on the chassis by the skid, and/or at least one additional pump assembly. The pump assembly is connected to the additional pump in series, parallel, or combinations thereof. The modular pumping unit of claim 11, wherein the pump assembly is connected to the at least one additional pump assembling in series, parallel, or combinations thereof.

The pump assembly further comprises at least one fluid unit comprising a fluid source. The mobile platform comprises a hitch assembly connectable to a vehicle. The fluid connectors comprise at least one valve, filter, restrictor, gauge, and/or diverter.

In another aspect, the disclosure relates to a horizontal pumping system for pumping fluid at a wellsite. The horizontal pumping system comprises a fluid unit and modular pumping units fluidly connected together. Each of the modular pumping units comprises a pump assembly comprising a motor and a pump; fluid connectors to fluidly connect the pump assembly to wellsite equipment to pass fluid therebetween during a pumping operation; and a mobile platform transportable to a wellsite. The mobile platform comprises a chassis and a wheel assembly. The chassis comprises a frame with saddle. The frame has a torque bar extending through the frame to prevent deflection. The frame is carried by the wheel assembly. The saddles are positioned about the frame to support the pump assembly in an operational position thereon during transport of the pump assembly and during the pumping operation at the wellsite.

The fluid unit comprises a fluid source and a pump. The fluid unit is connectable to a fluid source. The fluid unit is carried by the mobile platform. The fluid unit comprises a pump and a filter. The modular pumping units are connected in series or parallel. The modular pumping system may further comprise additional fluid connectors connectable between the modular pumping units. The fluid unit is carried by the mobile platform.

Finally, in another aspect, the disclosure relates to a method of pumping fluid at a wellsite. The method comprises providing a mobile platform comprising a chassis carried a wheel assembly; placing a pump assembly in an operational position on the mobile platform, the pump assembly comprising a motor and a pump; and while the pump assembly is in the operational position on the mobile platform, securing the pump to the chassis with saddles; transporting the pump assembly to the wellsite; fluidly connecting the pump assembly to wellsite equipment at the wellsite; and pumping fluid from the pump assembly to the wellsite.

The method may further comprise fluidly connecting the pump assembly to another pump assembly in series or parallel, fluidly connecting the pump assembly to a fluid unit; aligning the pump in the saddles; and/or securing the pump assembly in the operational position on a skid.

BRIEF DESCRIPTION OF THE DRAWINGS

So that the above recited features and advantages of the present disclosure can be understood in detail, a more particular description of the invention, briefly summarized above, may be had by reference to the embodiments thereof that are illustrated in the appended drawings. The appended drawings illustrate example embodiments and are, therefore, not to be considered limiting of its scope. The figures are not necessarily to scale and certain features, and certain views of the figures may be shown exaggerated in scale or in schematic in the interest of clarity and conciseness.

DETAILED DESCRIPTION

The description that follows includes exemplary apparatus, methods, techniques, and/or instruction sequences that embody techniques of the present subject matter. However, it is understood that the described embodiments may be practiced without these specific details.

The present disclosure relates to a modular horizontal pumping system that may be quickly deployed and redeployed at various locations as needed. The modular horizontal pumping system may include one or more pumping units (modules) and/or fluid units configurable for pumping fluid at a variety of wellsites. The pumping units may include features, such as a mobile platform, a pump assembly, and an operation station positionable at the wellsite.

The modular horizontal pumping system and its components may be configured for ease of transport, adaptability to oilfield equipment, and 'plug and play' operation. The modular horizontal pumping system may provide one or more of the following, among others: transportability, flexible operation, efficient installation and use, adaptability, configurability, equipment protection (e.g., housings, etc.), stable support of equipment, facilities for operator use, variable pumping capabilities, leveling and support of equipment, stiffening (e.g., rigidity) for torque prevention, operability from the mobile system and/or wellsite, temporary and/or permanent placement, etc.

Figure 1:
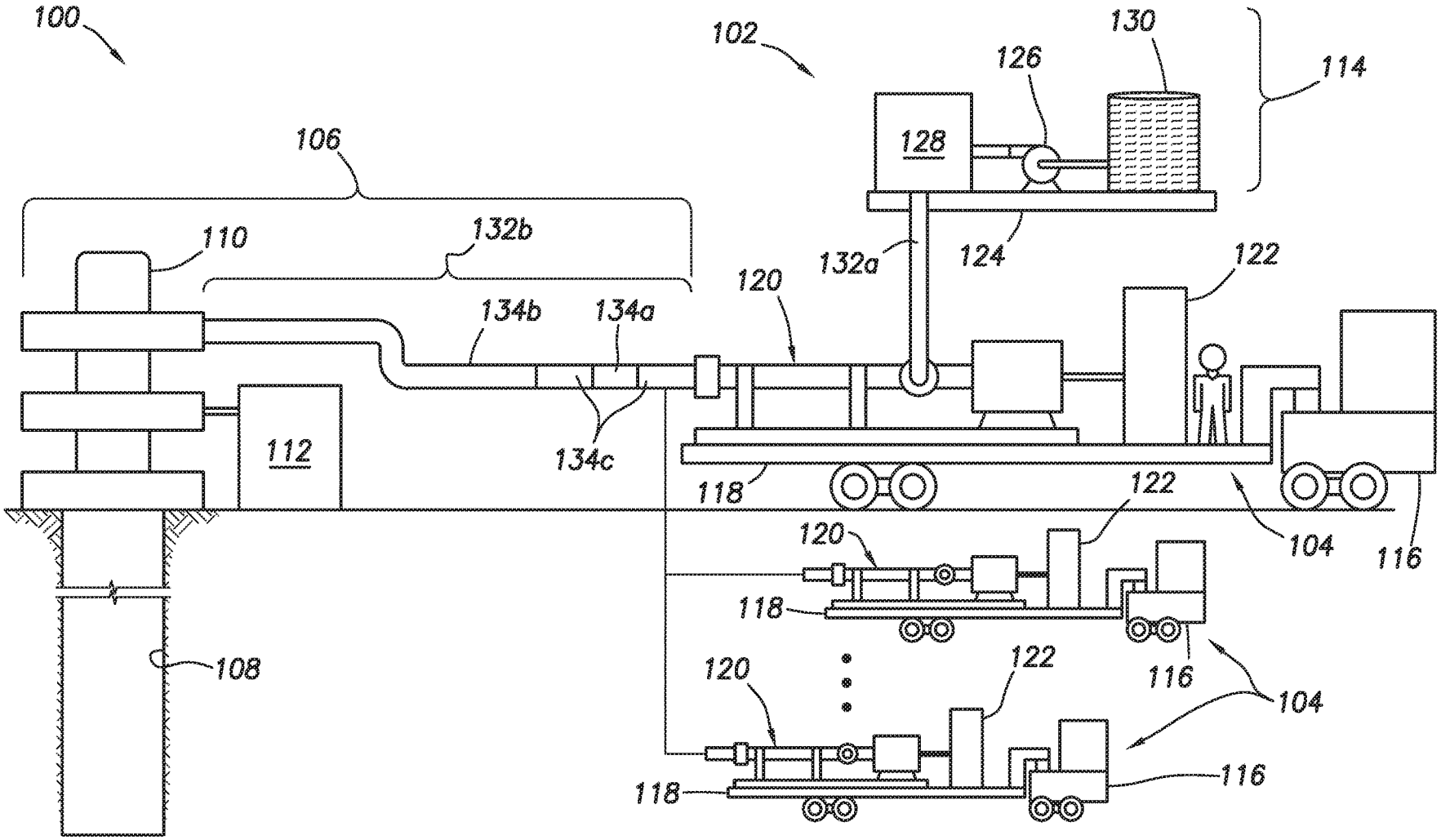
FIG. 1 is a schematic diagram depicting a wellsite with a modular horizontal pumping system including multiple pumping units.

FIG. 1 is a schematic diagram depicting a wellsite 100 with a modular horizontal pumping system 102 including multiple pumping units 104. The wellsite 100 includes wellsite equipment 106 positioned about a wellbore 108. The wellsite 100 may be, for example, a production wellsite 100 including a rig 110, and a surface unit 112 coupled to the rig 110 for operation therewith. The wellsite 100 may be used, for example in downhole jet pumping, injection into a disposal well, and/or other applications. The rig 110 may be, for example, a Christmas tree positioned about a production wellbore 108 to facilitate production of subsurface fluids. It will be appreciated that a variety of wellsite equipment may be positioned at the wellsite 100 for use with the modular horizontal pumping system 102.

The wellsite 100 is shown with three (or more) pumping units 104 and a fluid unit 114. The pumping units 104 are depicted as mobile units including or coupled to a vehicle 116 for transport to and from the wellsite 100 and or other wellsites. The pumping units 104 each include a mobile platform 118, a pump assembly 120, and an operation station 122. As indicated by the ellipses, any number of one or more pumping units 104 may be used at one or more wellsites 100.

The fluid unit 114 is coupled to the pumping unit 104 to provide fluid thereto. The fluid unit 114 as shown includes a fluid platform 124 and a fluid pump 126. The fluid unit 114 may also include additional features, such as a filter 128 and a fluid source (tank) 130. The fluid platform 124 may be a flat platform as shown, and/or a mobile platform with wheels similar to the mobile platform 118. The fluid pump 126, the filter 128, and the fluid source 130 are supported on the fluid platform 124. The fluid platform 124 may optionally be incorporated into our coupled to the mobile platform 118.

The fluid pump 126 is fluidly coupled to the pump assembly 120 by wellsite fluid connector 132*a* to pass fluid thereto. The pump assembly 120 is fluidly coupled to the wellsite equipment 106 by connector 132*b* for pumping fluid thereto. The connector 132*a* may be a fluid pathway extending between the pump assembly 120 and the fluid unit 114 to pass fluid therebetween. The connector 132*b* may be a fluid pathway extending between the pump assembly 120 and the rig 110 to pass fluid therebetween.

The fluid connectors 132*a,b* may include one or more flowlines, pipes, conduits, hoses, or other fluid pathway capable of passing fluid. The fluid connectors 132*a,b* may be provided with various flow devices, such as valves (e.g., check, blocking, throttling, butterfly, filter, etc.), filters, restrictors, gauges, diverters, and/or other devices. In the example shown, the fluid connector 132*b* includes a choke valve 134*a*, a check valve 134*b*, and spools 134*c*.

Figure 2A:
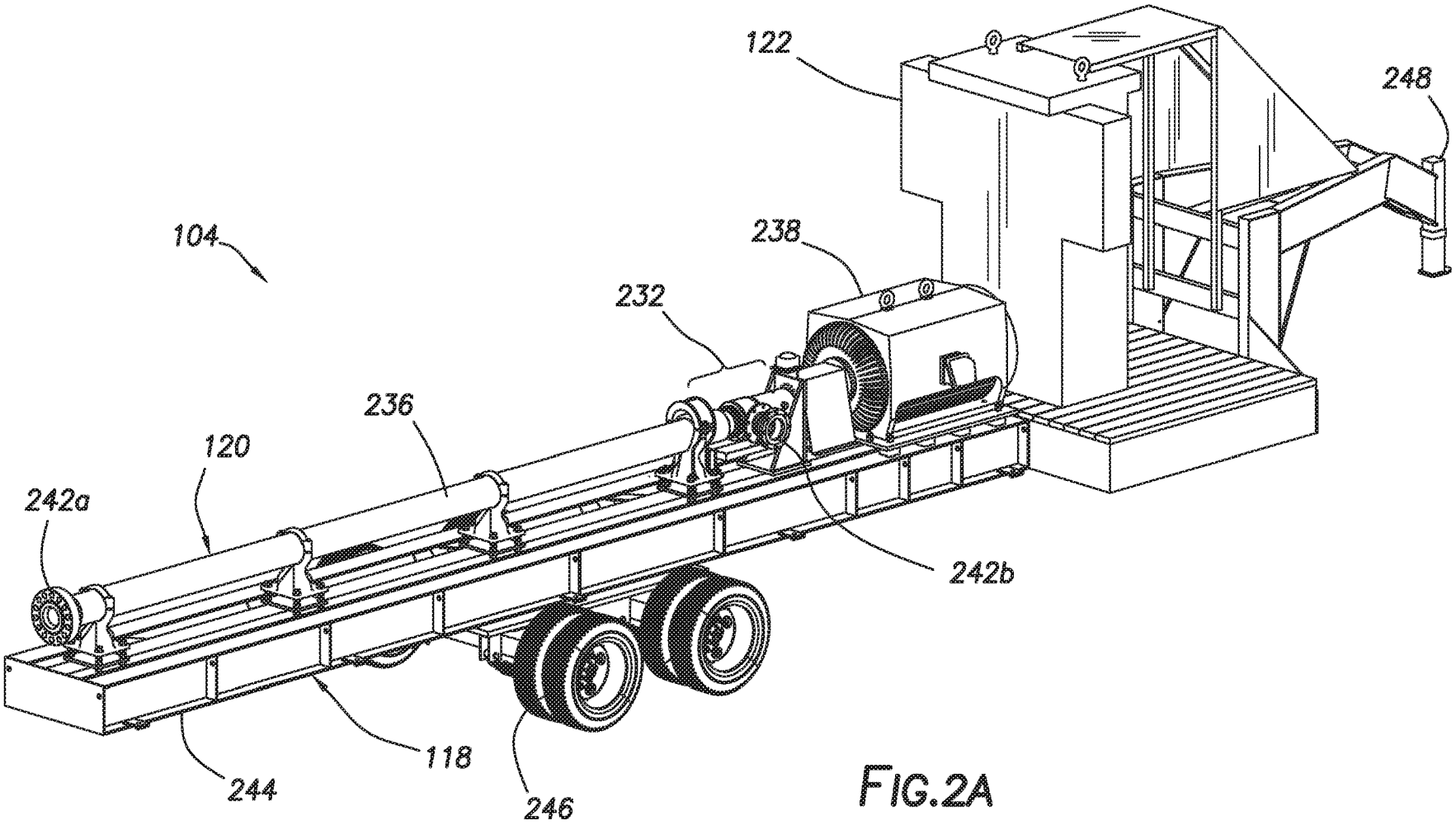
FIGS. 2A-2D are schematic diagrams depicting views of the pumping unit including a mobile platform, a pump assembly, and an operator station.
Figure 2B:
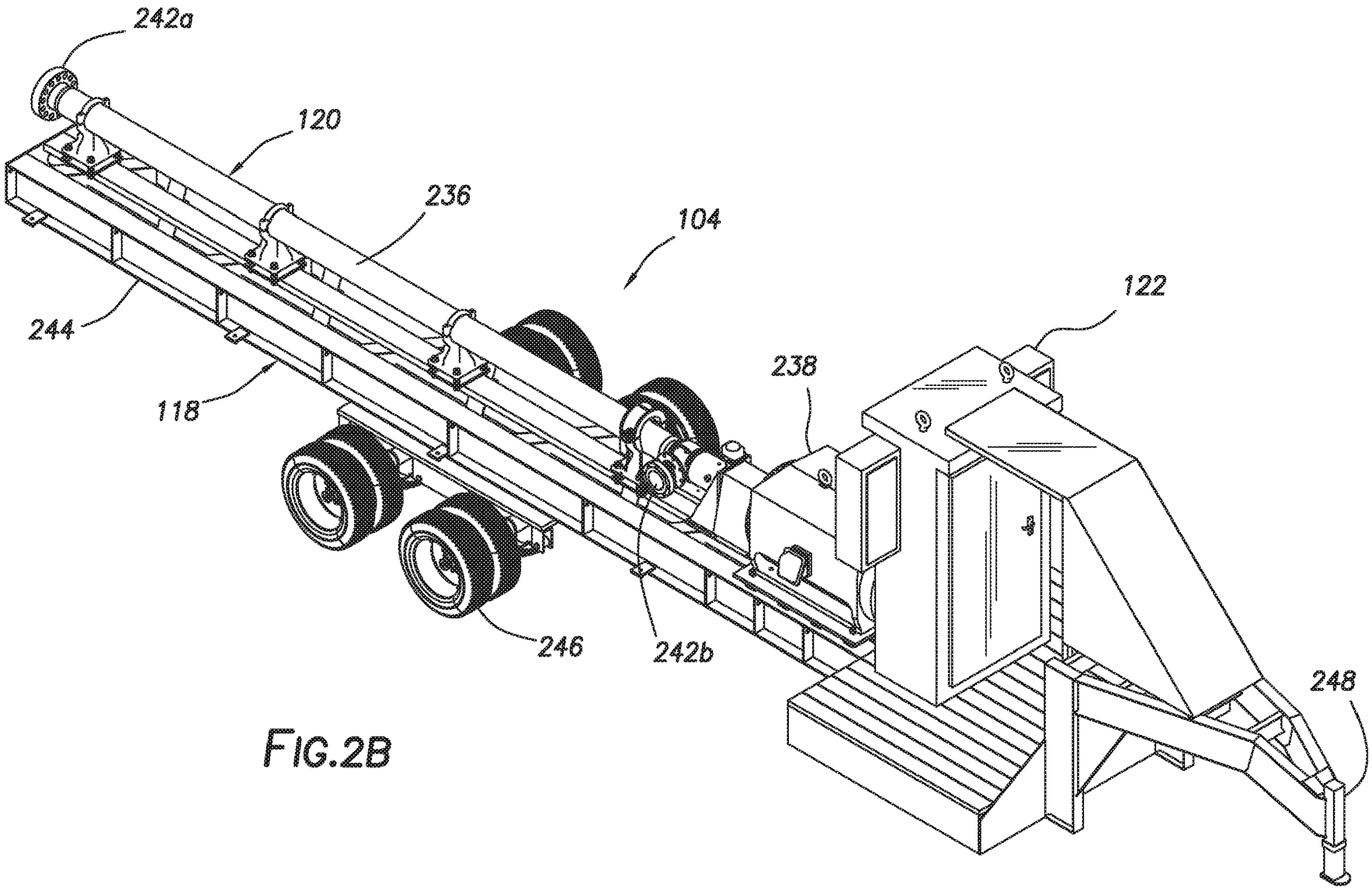
Figure 2C:
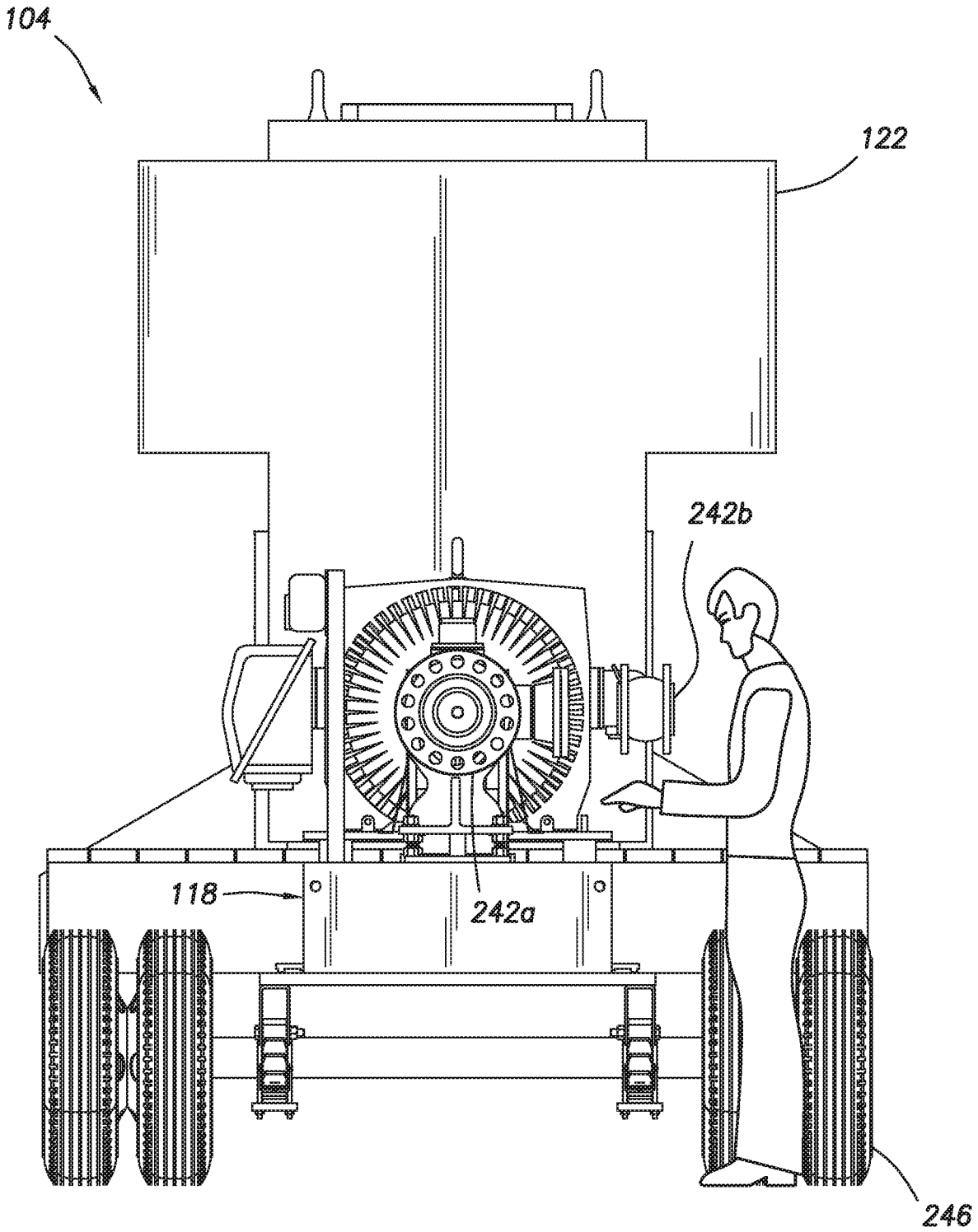
Figure 2D:
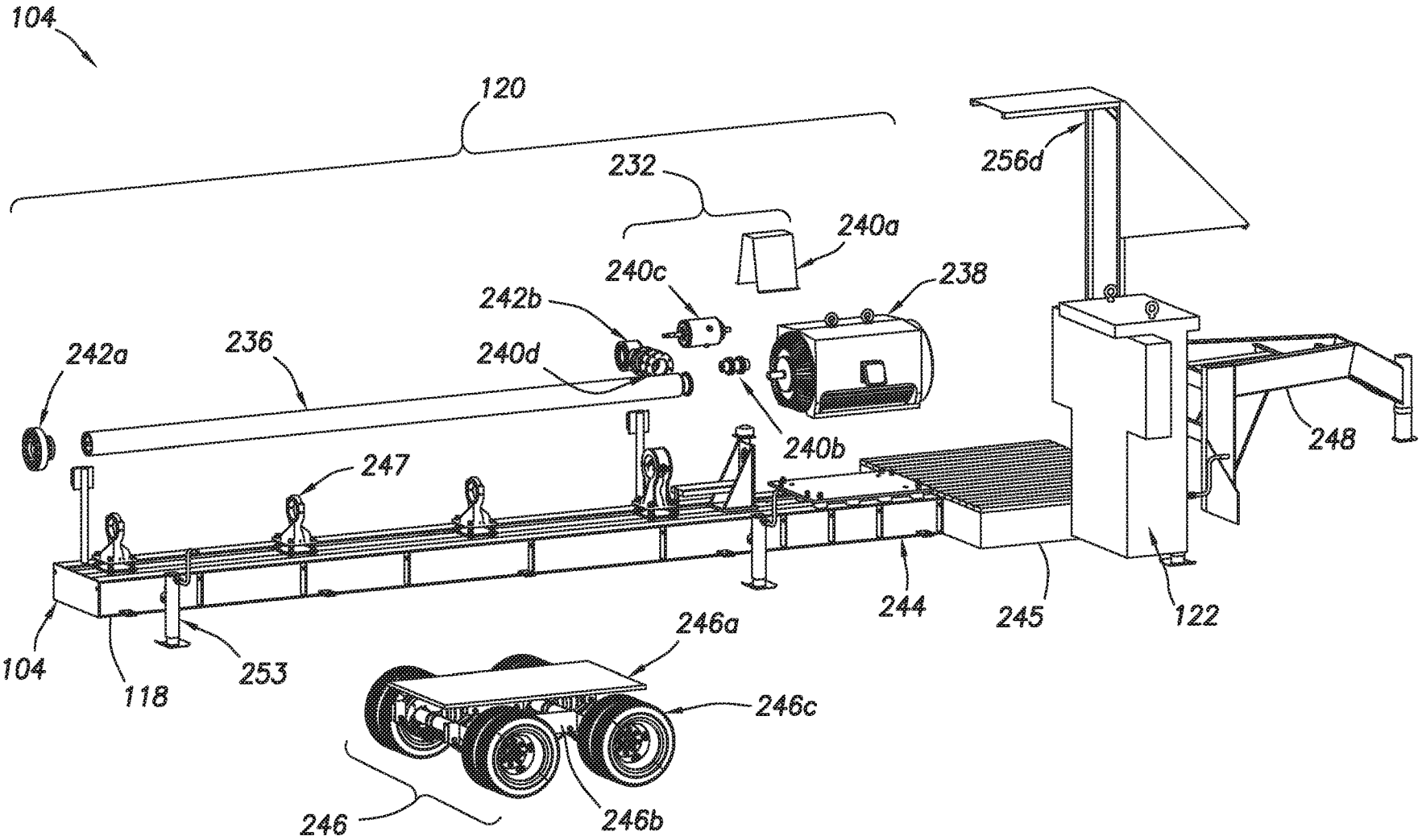

FIGS. 2A-2D are schematic diagrams depicting views of the pumping unit 104. FIGS. 2A-2C show front perspective, rear perspective, and rear views of the pumping unit 104. FIG. 2D shows an exploded view of the pumping unit 104. The pumping unit 104 includes a pump 236 and a motor 238 supported on the mobile platform 118. The pump 236 may be a fluid pump, such as a multistage centrifugal pump, capable of pumping fluid from the fluid source 130 to the wellbore 108 (FIG. 1). The fluid pump 236 may be used, for example, to boost fluid pressure at specified volumes for enabling downhole jet pumping of injection fluids. The motor 238 may be an electric motor or combustion engine capable of powering the pump 236.

The pumping unit 104 also includes a motor connector 232 between the pump 236 and the motor 238. The motor connector 232 may include various devices for translating power of the motor 238 to drive the pump 236. The motor connector 232 as shown includes a coupling guard 240*a*, a motor coupling 240*b*, a thrust chamber 240*c*, and a flex expansion joint 240*d*. The pumping unit also includes a discharge head 242*a* connectable to connector (pathway) 132*b* and an intake 242*b* connectable to the connector 132*b* (FIG. 1) for passing the fluid therethrough. The pumping unit 104 may also optionally include other features, such as saddle assemblies, multistage centrifugal pumps, intakes, thrust chambers, seals, couplings, power, etc.

Figure 3A:
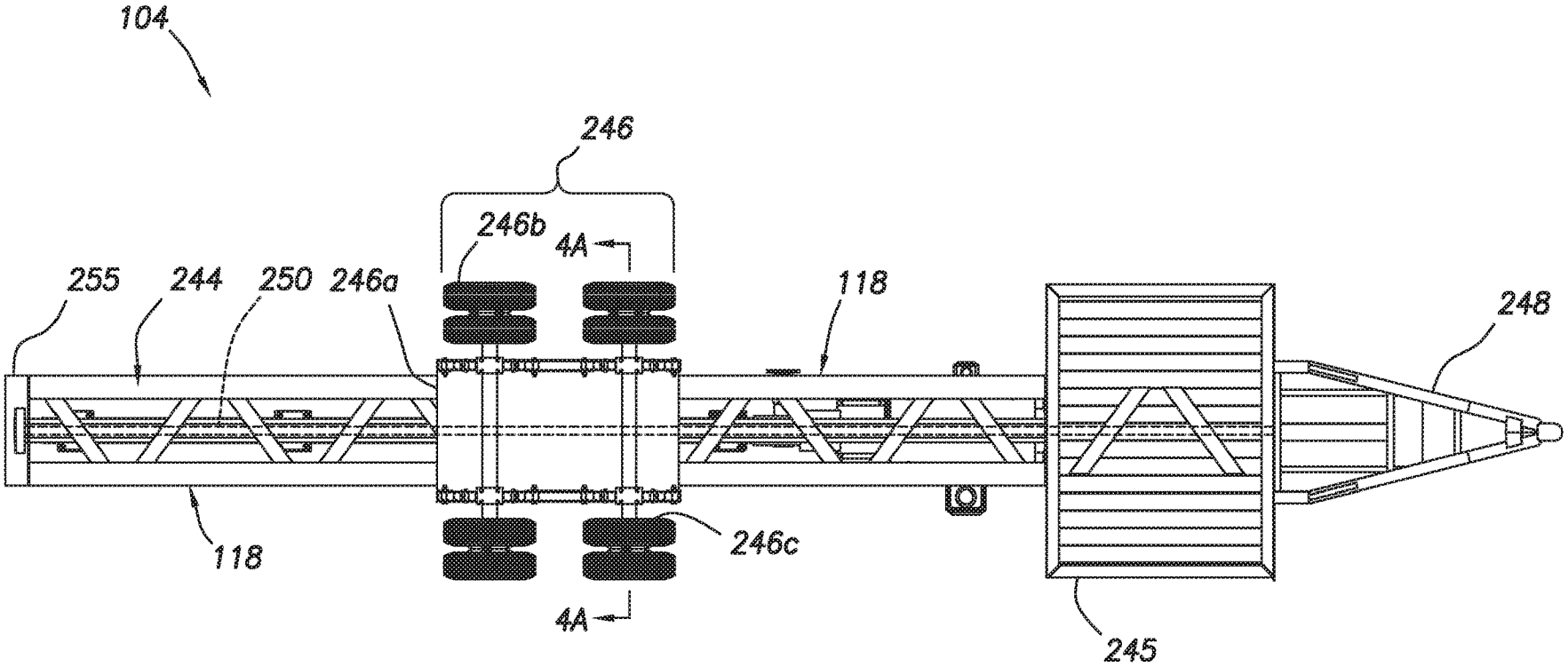
FIGS. 3A-3D are schematic diagrams depicting portions of the mobile platform.
Figure 3B:
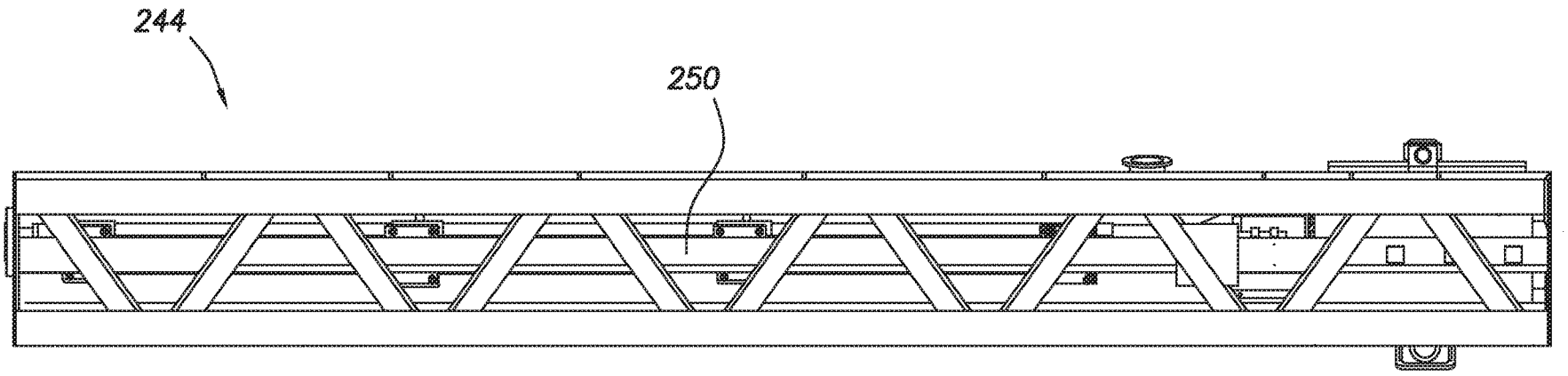
Figure 3C:
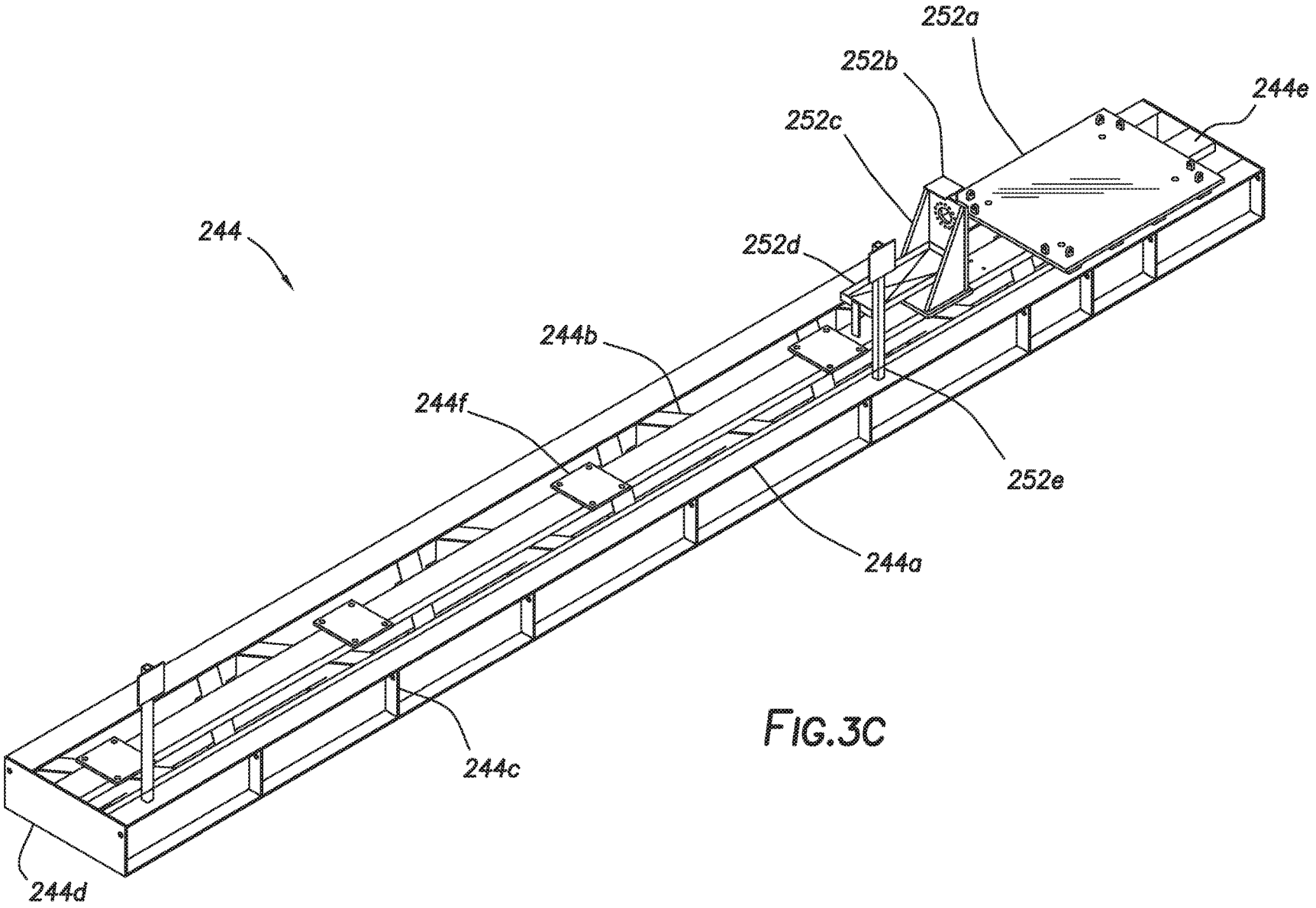

Referring to FIGS. 2A-2D and 3A-3C, the mobile platform 118 is shown in greater detail. FIG. 3A shows a bottom side of the pumping unit 104. FIGS. 3B and 3C show bottom and perspective views of a chassis 244. As shown by these views, the mobile platform 118 may be an integral unit with its components integrally secured into a modular unit.

The mobile platform 118 includes the chassis 244, a station platform 245, a wheel assembly 246, saddles (or pump supports or couplers) 247, and a hitch assembly 248. In this version, the chassis 244 is a t-shaped structure capable of supporting the pump assembly 120 and the operation station 122 during transport and/or operation. The station platform 245 is connected to a front end of the chassis 244 adjacent the hitch assembly 248.

The pump assembly 120 is secured to the chassis 244 by the saddles 247. The chassis 244 may have a frame structure including beams 244*a* (or trusses) connected by cross braces 244*b*, lugs 244*c*, endplates 244*d*, and channel 244*e* with saddle plates 244*f*. The chassis 244 may be a network of trusses welded together to define a load-bearing superstructure capable of enduring tension, compression, and/or other static and/or dynamic loads during transport and/or when stationary.

The chassis 244 may be provided with support members for supporting the motor 238 and the pump 236 thereon. A torque bar 250 extends through the chassis 244 to provide support and/or to prevent torsion during transport. A motor plate assembly 252*a* is positioned on the chassis 244 to receive the motor 238. Other devices, such as a pedestal assembly 252*b*, sensor base plate assembly 252*c*, drip tray assembly 252*d*, and pressure switch mount 252*e* may also be provided.

The mobile platform 118 may also be provided with other features, such as lights (e.g., taillights 255), jacks 253, an automated level, stairs, etc. The lights may be provided at various locations about the mobile platform 104 as needed. Retractable stairs may be provided for accessing the platform. An automated level may be incorporated into or attached to the mobile platform to level the equipment for operation.

The jacks 253 are attached to the chassis 244 and extend therebelow. The jacks 253 may be lowered from one or more portions of the chassis 244 to support the mobile platform 118. The jacks 253 may lift the wheel assembly 246 off the ground to support the mobile platform 118 in a fixed position at the wellsite. The jacks 253 may be adjustable to permit leveling and positioning of the pumping system 102 (FIG. 1). Once the mobile platform 118 reaches a site, the jacks 253 may be lowered to secure the mobile platform 118 in a fixed position. Optionally, the mobile platform 118 may be secured into position on the pad at the wellsite 100 (FIG. 1).

Figure 3D:
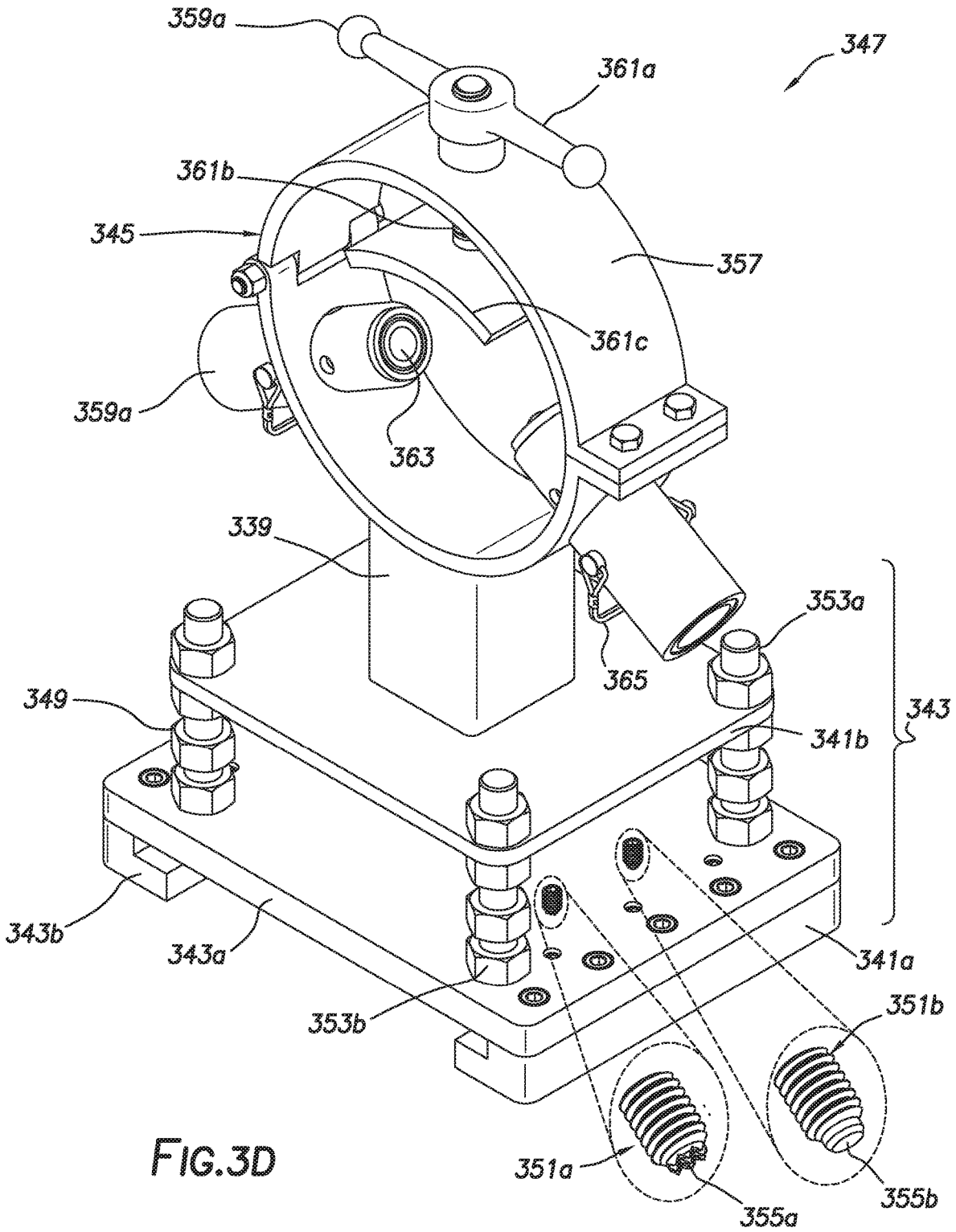

Referring to FIGS. 2A-2D and 3D, the saddles may have a variety of different configurations, such as the basic saddle 247 of FIG. 2D, and an aligned saddle 347 of FIG. 3D. An additional adjustable saddle 647 is described further herein with respect to FIG. 6B. As shown in the detailed view of FIG. 3D, each version may include a base 341 secured to the chassis 244, and a receptacle 345 positioned above the base 341 to receive the pump 236. The base 341 may be affixed to the saddle plates 244*f* of the chassis 244 as shown in FIG. 3C, or to other means secured to the chassis 244, such as a skid 660 (FIG. 6B). The saddles 347 may be shaped and/or positioned in various configurations along the chassis 244 and/or about the pump 236 to facilitate transport and/or operation of the pumping system.

In the example of FIG. 3D, the aligned saddle 347 includes the base 341 and the receptacle 345, with a neck 339 extending therebetween. The base 341 is removably secured to the saddle plate 244*f*. The receptacle 345 is positioned a distance above the base 341 to receivingly support the pump 236 a distance above the chassis 244 for alignment and operation with the pump motor 238. The base 341 has a lower base plate 341*a*, and an upper base plate 341*b* connected a distance above the lower base 341*a* by base connectors 349. The lower base plate 341*a* has a flat upper portion 343*a* with a flanges 343*b* extending below the flat upper 343*a* portion to define a pocket to receivingly and grippingly engage the saddle plates 244*f*. The flat upper portion 343*a* may be removably connected to the flanges 343*b* by connectors to facilitate connection with the saddle plate 244*f*.

The lower base plate 341*a* may be provided with engagement devices, such as the grub screws 351*a,b*, to mitigate vibration, increase impingement, and/or increase gripping. As shown in FIG. 3D, the grub screws 351*a,b* extend through the lower base plate 341*a* for engagement with the saddle plate 244*f*. The grub screws 351*a,b* as shown are threaded members disposable in threaded holes in the flat upper portion 343*a* of the lower base plate 341*a*. The grub screws 351*a,b* may be screwed into the holes in the lower base plate 341*a* such that a contact end 355*a,b* of the grub screws 351*a,b* engages the saddle plate 244*f*. As demonstrated by the examples shown, the grub screws 351*a,b* may have an end, such as a serrated (toothed) contact end 355*a*, shaped to grippingly engage with the saddle plate 244*f* or flat contact end 355*b* to vibratingly engage with the saddle plate 244*f*. These grub screws 351*a,b* may be made of tungsten carbide or other material for wear purposes. A pad may be provided along the chassis 244 to assist in dampening vibration transfer onto the chassis 244. One or more of various engagement devices may be positioned about the lower base plate 341*a*.

The upper base plate 341*b* is a flat plate positioned a distance above the lower base plate 341*a*. The upper base plate 341*b* may be positioned to support the receptacle 345 and the neck 339 in a desired position. The base connector 349 may be any connector capable of securing the upper base plate 341*b* in a spaced apart position above the lower base plate 341*a*. The base connectors 349 include a rod 353*a* that extends through the upper base plate 341*b* and the lower base plate 341*a* and is secured by nuts 353*b*. The rod 353*a* may have threaded portions for receiving the nuts 353*b* and securing the upper and lower base plates 341*a,b* therebetween.

The receptacle 345 may include a ring 357 for receivingly engaging the pump 236, and positioning members 359*a,b* to position the pump 236 in the ring 357. In this version, the receptacle 345 includes two arcuate portions hingedly connected together to encircle and clamp about the pump 236. The ring 357 may be secured in a closed position by bolts. The positioning members include a press 359*a* and extension rods 359*b* positioned about the ring to align the pump 236 within the ring 357.

The press 359*a* includes a crank 361*a*, a screw 361*b*, and an arch 361*c* supported about the ring 357. The screw 361*b* extends through a threaded hole in the ring 357 with the arch 361*c* positioned at an internal end of the screw 361*b* within the ring 357. The crank 361*a* is positionable at an external end of the screw 361*b* outside of the ring 357. The arch 361*c* is an arcuate shaped member shaped to conform to an outer surface of the pump 236. The arch 361*c* is positionable within an inner diameter of the ring 357 in arcuate alignment with a portion of the ring 357.

The crank 361*a* is fixed to the screw 361*b* such that rotation of the crank 361*a* axially moves the screw 361*b* through the threaded hole of the ring 357, thereby extending and retracting the arch 361*c*. The arch 361*c* is connected to the screw 361*b* such that the arch 361*c* moves axially with the screw 361*b* (without rotation) to selectively vary an inner diameter of the ring 357. When the pump 326 extends through the ring 357, the crank 361*a* may be rotated to advance the arch 361*c* via the screw 361*b* into engagement with an outer surface of the pump 236. The amount of torque applied to the crank 361*a* can vary to selectively apply force to the pump 236, thereby moving the pump 236 to a desired alignment within the ring 357. The torque can also be defined to selectively permit or restrict rotation of the pump 236 within the ring 357, and/or to allow adjustment for receipt of pumps 236 of various diameters.

One or more of the extension rods 359*b* may extend through the ring 357 to support the pump 236 in a desired position within the ring 357. The extension rods 359*b* as shown are cylindrical members adjustably positioned about the ring 357, with an internal end of the extension rods 359*b* positionable in engagement with the outer surface of the pump 236. The internal end may be provided with rollers 363 (e.g., balls, bearings, etc.) movably positioned in the internal end of the extension rod 359*b*. Such rollers 363 may movably engage the outer surface of the pump 236 to allow movement (e.g., rotation, sliding, etc.) of the pump 236 within the ring 357. The extension rods 359*b* may be provided with handles 365 to facilitate insertion of the extension rods 359*b* into the ring 357.

The configuration of the saddle 347 is defined to allow for support and alignment of the pump 236. In the example of FIG. 3D, contact with the pump 236 is provided by the receptacle 345 at three intervals about an outer diameter of the pump 236. Various numbers of the positioning members 357*a,b* may be positioned in a variety of locations about the ring 357 to provide the desired contact. The ring 357 and the positioning members 357*a,b* may be sized and positioned to allow for use with various shapes and sizes of pumps 236. The positioning members 357*a,b* may be selectively extended and retracted for varied alignment of the pump 236 within the ring 357. The saddle 347 may be used with similar or different saddles 247, 347, 647 positioned along the chassis 244. The positioning members 357*a,b* may be selectively adjusted to maintain alignment of a centerline of the pump 236 along the chassis 244.

The example of FIG. 3D shows a specific configuration of a ring, neck and base 343 with specific components in specific positions, such as the extension rods 359*b* positioned in a lower portion of the ring 357 with the press 359*a* extending through a top of the ring 357. It will be appreciated that various combinations of the saddles 247, 347, and 647 and other features described herein may be used in various positions to achieve the desired positioning and securing of the pump 236 about the chassis 244 and/or relative to the pump motor 238.

Figure 4A:
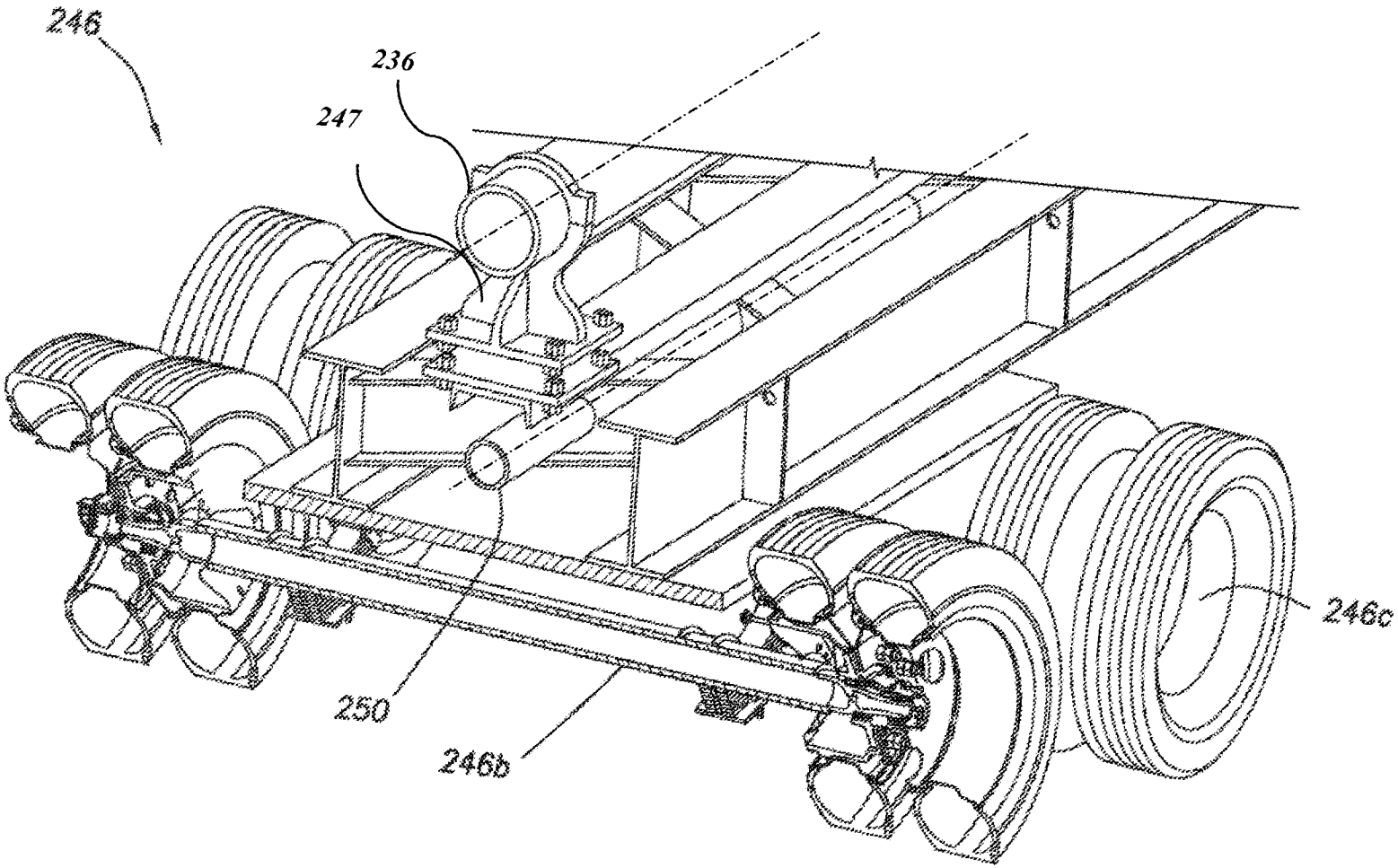
FIGS. 4A-4B are schematic diagrams depicting portions of a wheel assembly of the mobile platform.
Figure 4B:
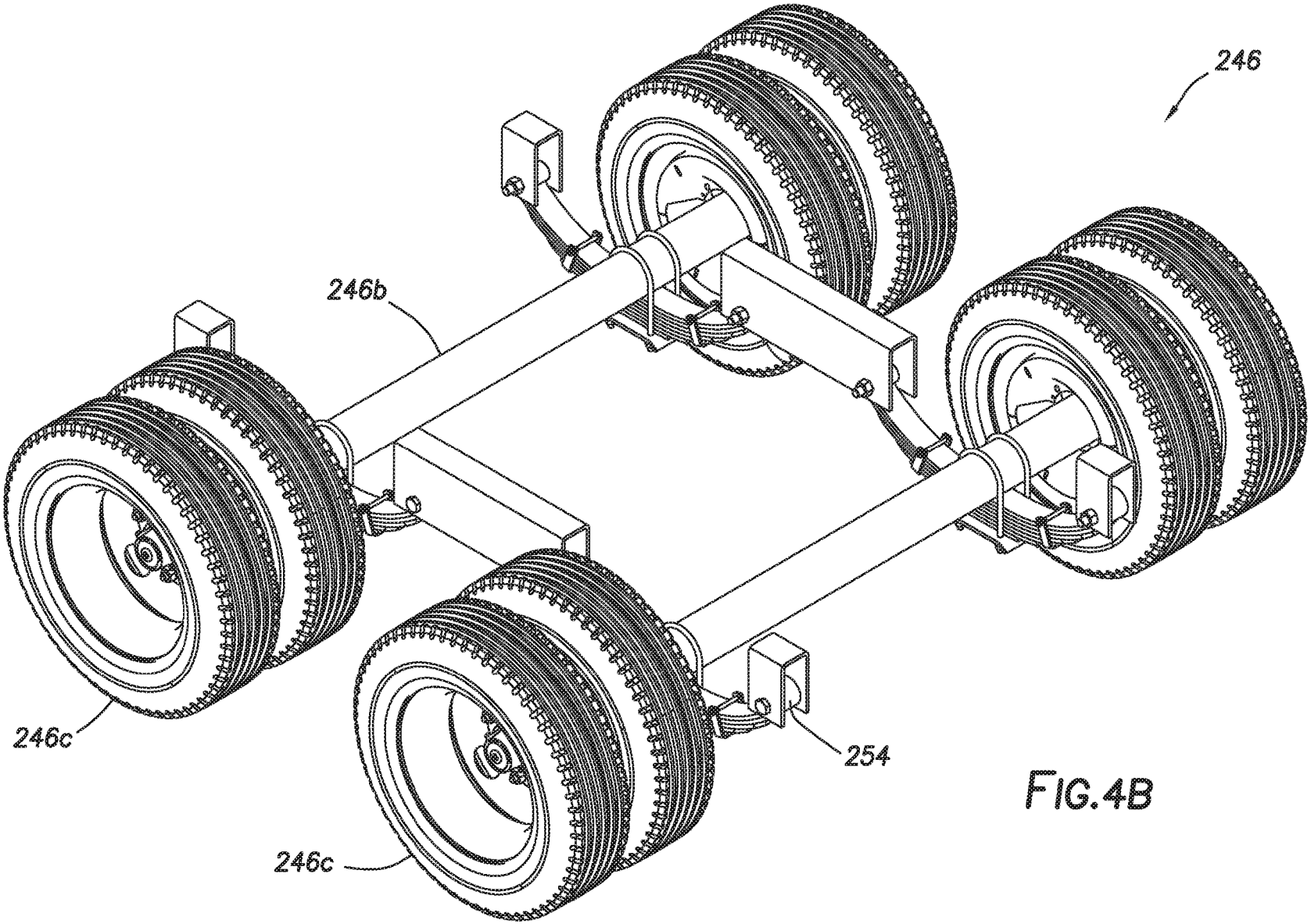

Referring to FIGS. 2D, 3A, and 4A-4B, the wheel assembly 246 is shown in greater detail. FIG. 4A is a cross-sectional view of the wheel assembly 246 of FIG. 3A taken along line 4A-4A. FIG. 4B shows a portion of the wheel assembly 246. The wheel assembly 246 may be a unitary structure or a pre-assembled item, removably attached to the chassis 244. Other portions of the mobile platform 118, such as the fluid unit (114 of FIG. 1), may also be pre-assembled for quick replacement and/or installation.

The wheel assembly 246 includes a chassis plate 246*a*, a wheel frame 246*b*, and wheels 246*c*. The chassis plate 246*a* secures the wheel assembly 246 to the chassis 244. The wheel frame 246*b* includes axles extending through pairs of wheels 246*c*. Pivot arms 254 are also provided along the wheel frame 246*b* to secure the wheel assembly 246 to the chassis 244 (e.g., with leaf springs).

Figure 5A:
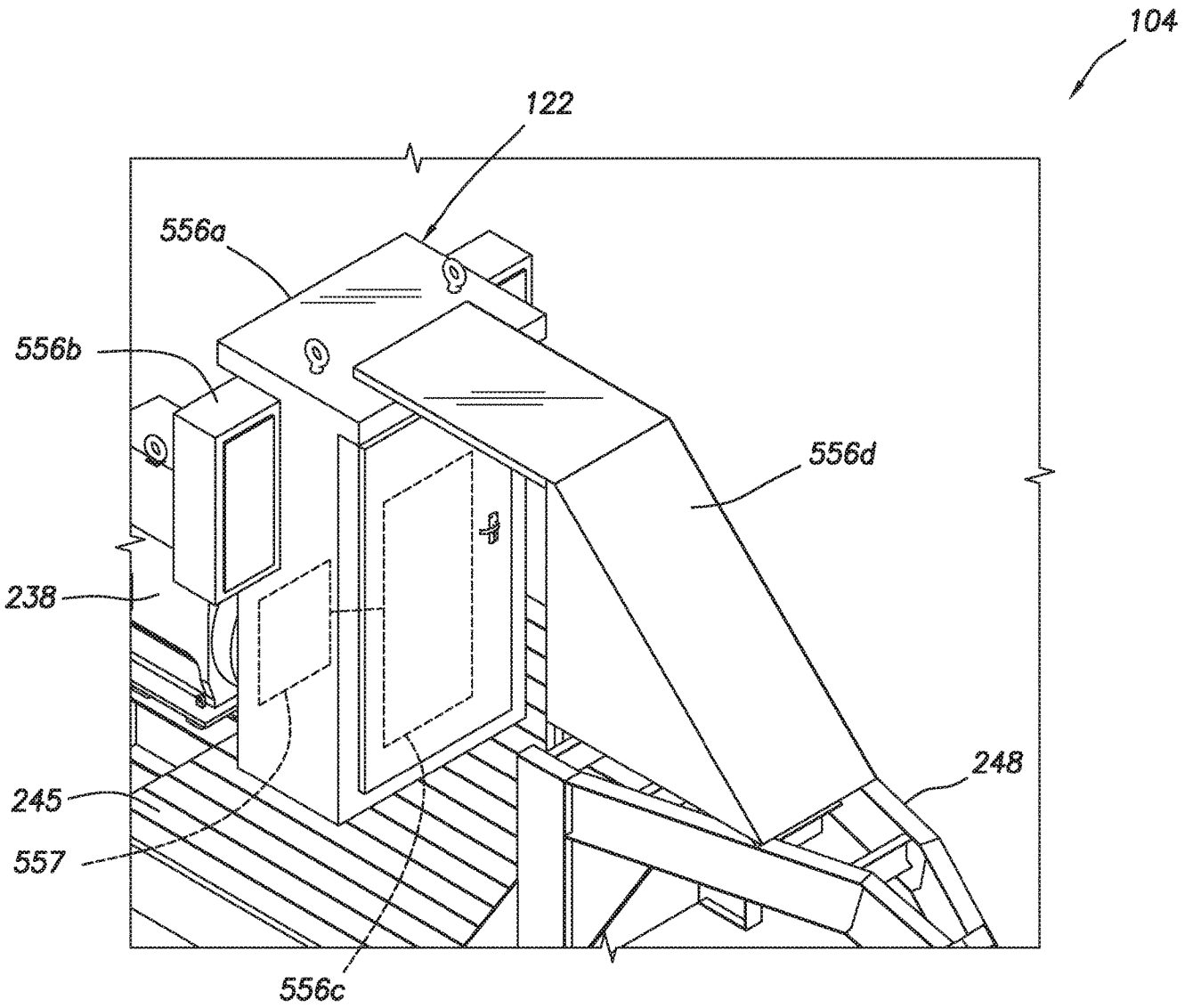
FIGS. 5A-5B are a schematic diagram depicting the operation station.
Figure 5B:
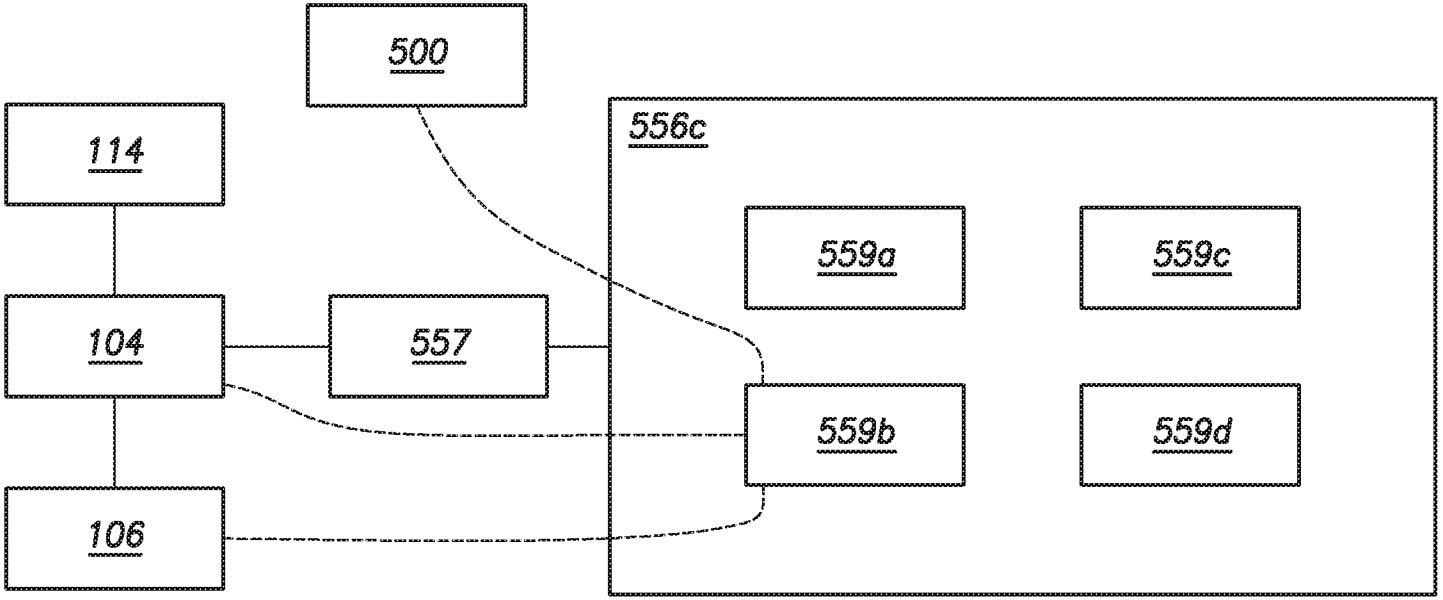

Referring to FIGS. 2B and 5A-5B, the operation station 122 is depicted in greater detail. FIG. 5A shows a portion of the pumping unit 104 depicting the operation station 122. FIG. 5B shows an electrical diagram of the electronics of the operation station 122. The operation station 122 includes a housing 556*a*, a control panel 556*b*, electronics 556*c*, and a support arm 556*d*.

The housing 556*a* is depicted as a vertical structure like a room with a door. The housing 556*a* is positioned on the station platform 245 of the mobile platform 118 adjacent the motor 238. The control panel 556*b* extends from the housing 556*a* at eye level for an operator. The control panel 556*b* is positioned such that an operator facing the control panel 556*b* is also facing the pumping unit 104 to view operation thereof.

The support arm 556*d* extends from the housing 556*a* to the hitch assembly 248. The support arm 556*d* has a top portion extending from a top of the housing 556*a* to provide a vertical cover overhead of the operator. An angled portion of the support arm 556*d* extends from the top portion to the hitch assembly 248. The top portion is supported on one end by the operation station 122 and on an opposite end by the angled portion of the support arm 556*d*.

The electronics 556*c* may be stored in the housing 556*a*. The electronics 556*c* may include a central processing unit 559*a* (e.g., CPU, computer, controller, etc.), a communicator 559*b* (e.g., transceiver, internet connections, etc.), an input/output device 559*c* (e.g., monitor, keyboard, mouse, etc.), and a power supply 559*d* (e.g., battery). Other electronics may be provided for operation of the pumping unit 104, wellsite 100, and/or other oilfield and/or transportation operations. The electronics 556*c* may also include or be coupled to a drive 557, such as a variable control drive (VCD) 557 coupled to the motor 238. The VCD 557 and/or other of the electronics 556*c* may be used to control operation of the pump assembly 120, the pumping unit 104, the fluid unit 114, and/or portions of the wellsite equipment 106. The electronics 556*c* may optionally be coupled to the surface unit 112 (FIG. 1) and/or other onsite or offsite units 500 for operation therewith.

Figure 6A:
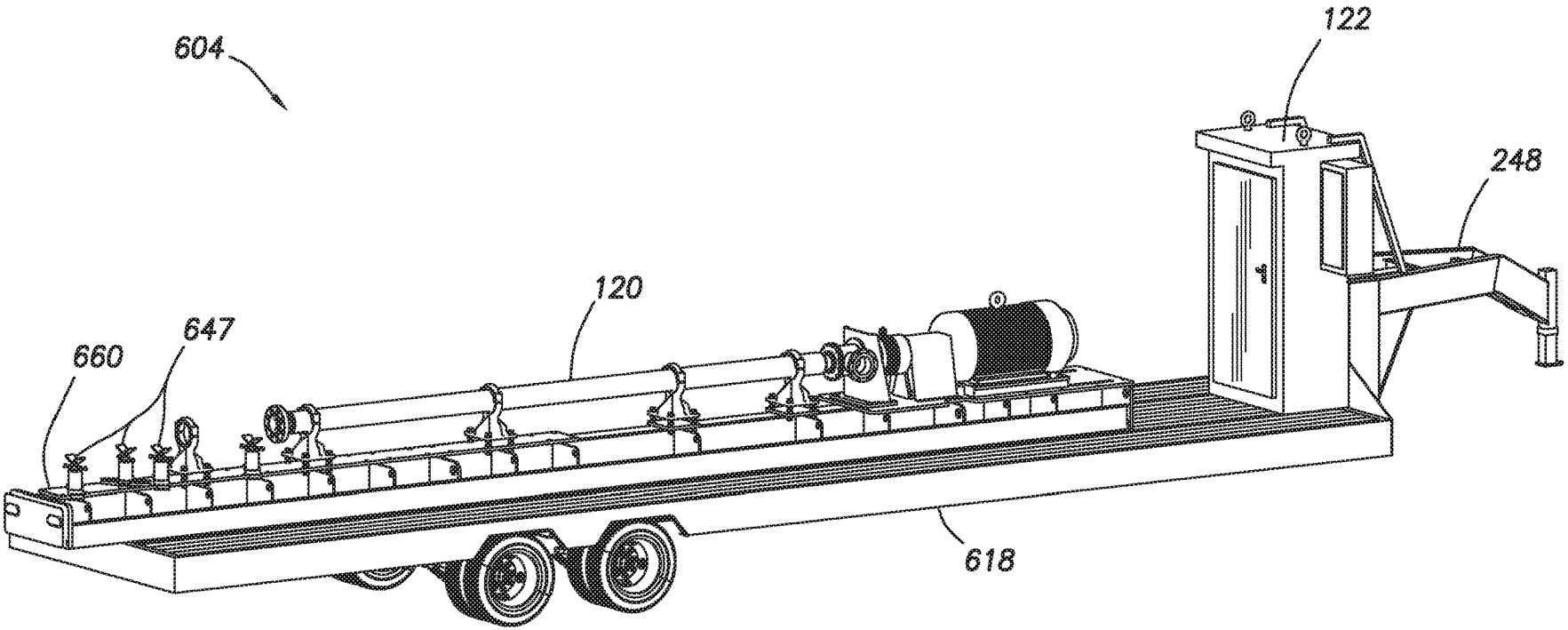
FIGS. 6A-6C are schematic diagrams depicting another pumping unit.
Figure 6B:
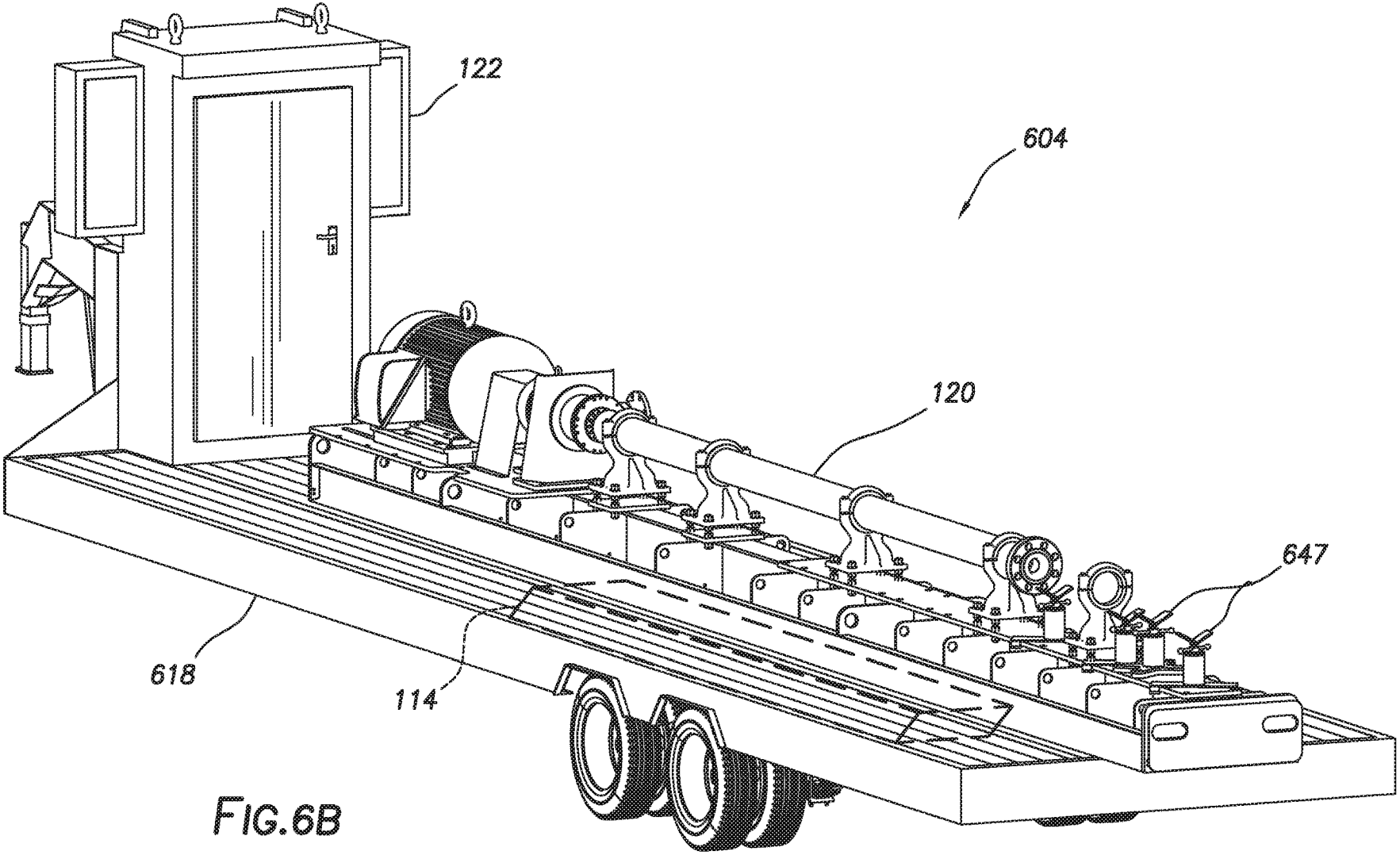
Figure 6C:
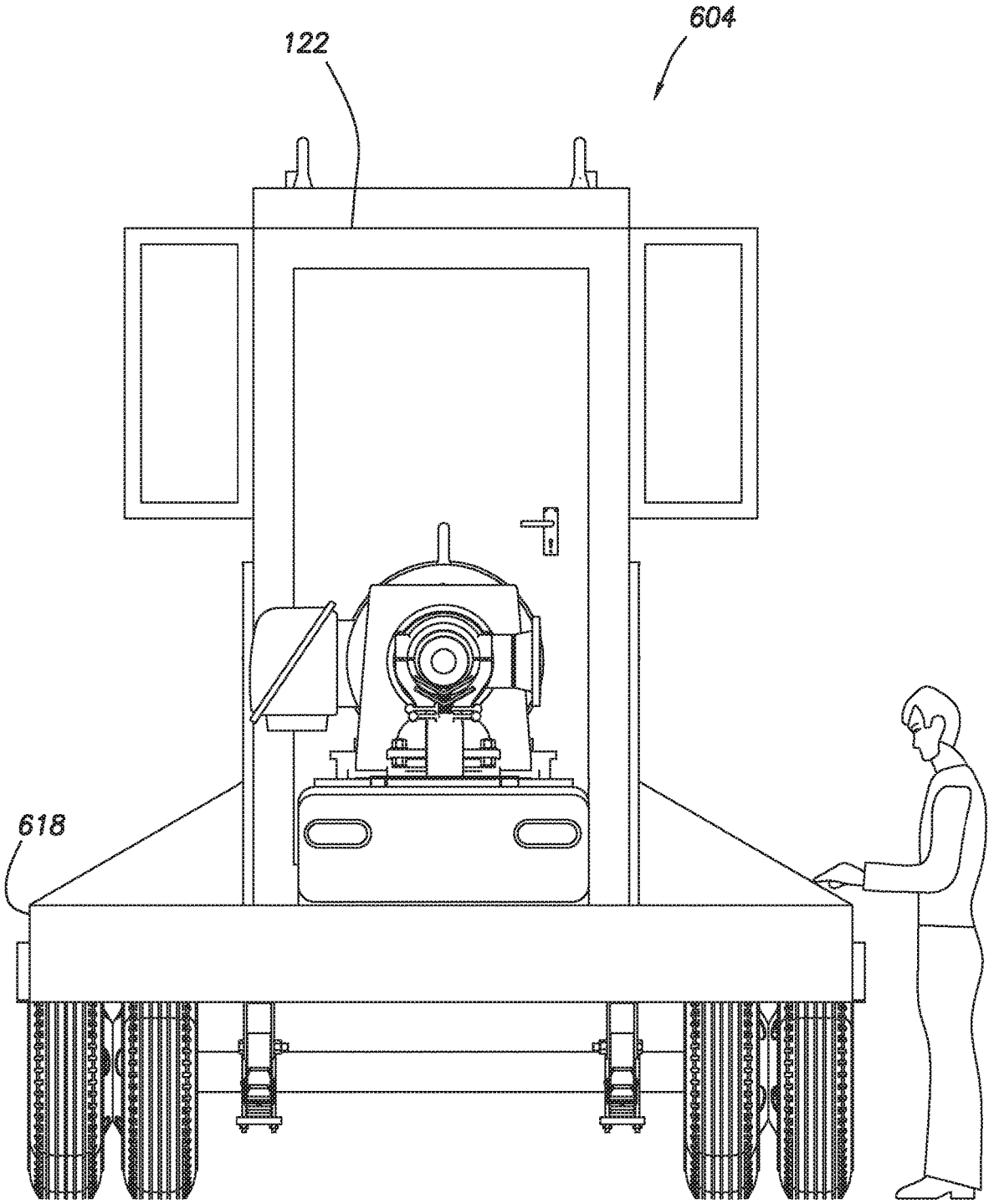

FIGS. 6A-6C show another version of the pumping unit 604. As shown by this version, the pumping unit 604 may have separate components. This version is similar to the pumping unit 104, except that the pump assembly 120 is secured to the mobile platform 618 by a skid 660 with adjustable saddles 647. The adjustable saddles 647 are similar to the saddles 247, except these adjustable saddles 647 have an open receptacle to receive the pump 236, and may be adjustable to permits leveling and positioning of the pump assembly 120 on the skid 660. As also shown by FIG. 6B, the pumping unit 604 may also carry the fluid unit 114.

The skid 660 may be a flat structure supporting the pump assembly 120 thereon. The skid 660 with the pump assembly 120 thereon may be removably attached to the mobile platform 618. The mobile platform 618 may be similar to the mobile platform 118, except that it is a rectangular shaped member with slots shaped to receive the skid 660. As also shown in this example, the operation station 122 is positioned at a front end of the mobile platform 618 adjacent the hitch assembly 248.

Figure 7A:
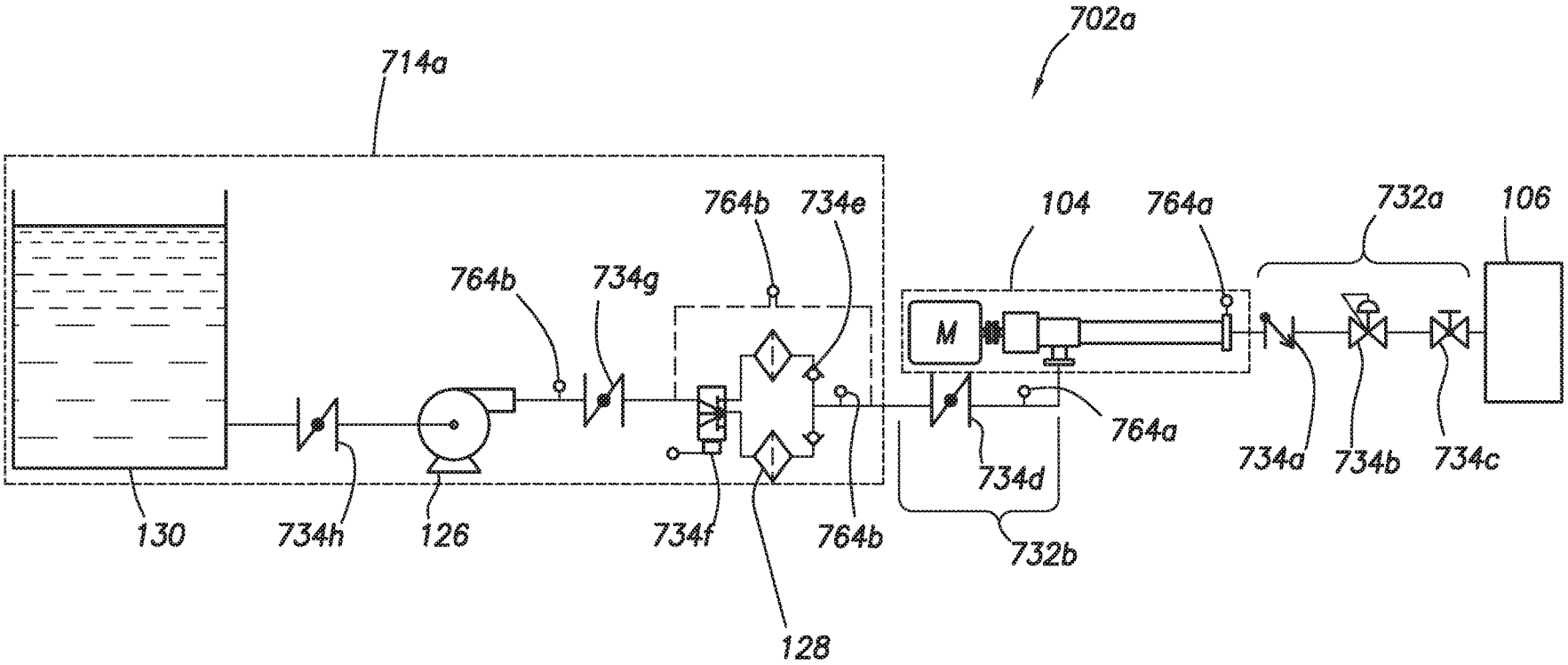
FIGS. 7A-7E are schematic diagrams depicting various flow configurations of the modular horizontal pumping system.

FIGS. 7A-7E show various configurations of the pumping system 702*a-e*. FIG. 7A shows the pumping system 702*a* in a basic configuration with a single pumping unit 104 and a fluid unit 714*a*. In this version, the pumping unit 104 is connected to the wellsite 100 by a connector (coupling) 732*a* including a pathway with a swing check valve 734*a*, a choke valve 734*b*, and a globe valve 734*c* to selectively pass the fluid to the wellsite equipment 106. The pumping unit 104 is also connected to the fluid unit 714*a* by connector 732*b* including pathway with a butterfly valve 734*d* and a check valve 734*e*.

The fluid unit 714*a* in this version includes the fluid (charge) pump 126, a fluid source 130, and two filters 128. Filter and butterfly valves 734*f,g* are positioned along the pathway between the pump 126 and the filters 128, and a butterfly valve 734*h* is provided along the pathway between the fluid pump 126 and the fluid source 130. Measuring devices (or monitors), such as pressure transducers 764*a* and pressure gauges 764*b* are also provided at various locations along the pathways of the pumping system 702*a*.

Figure 7B:
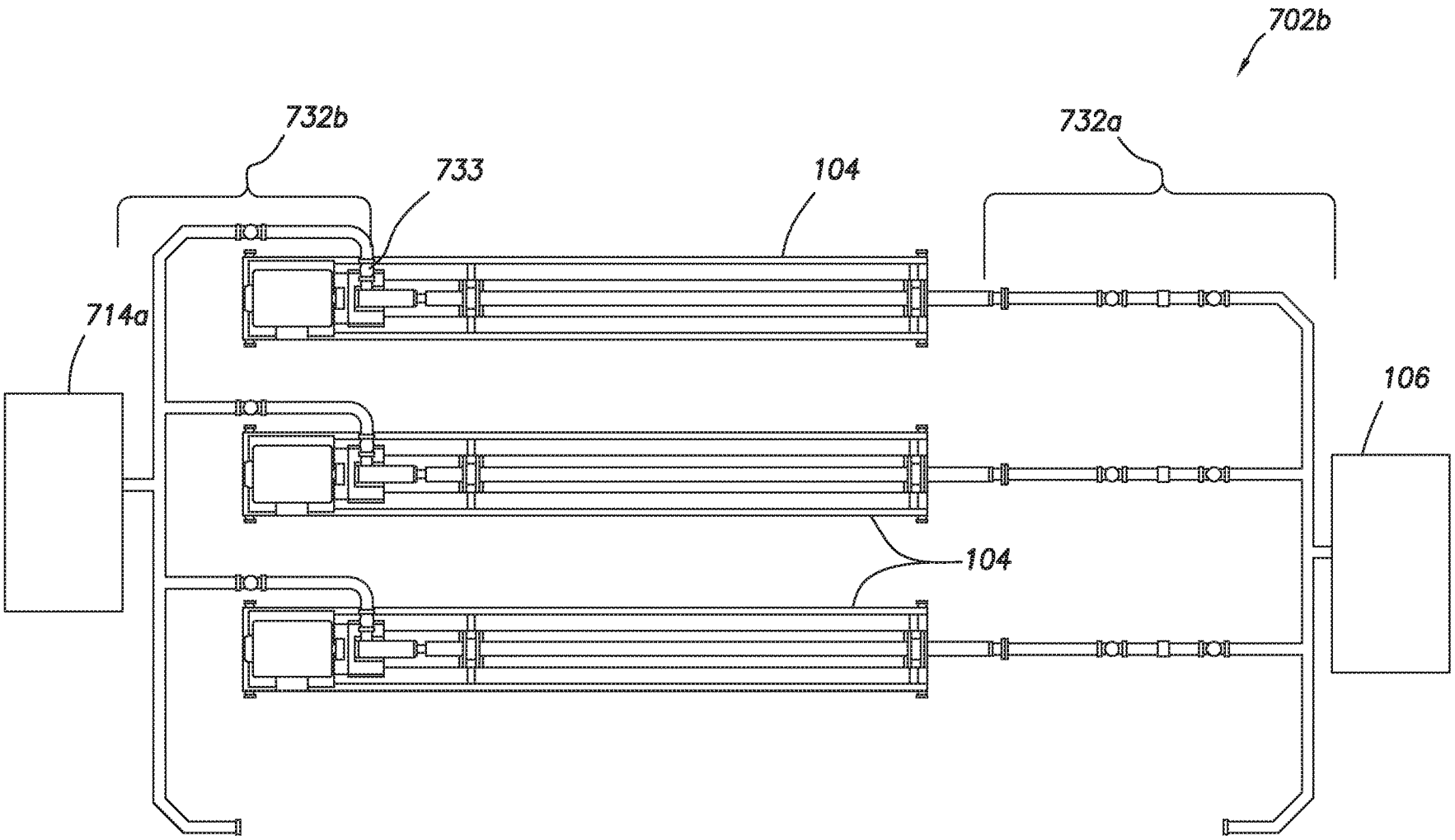
Figure 7C:
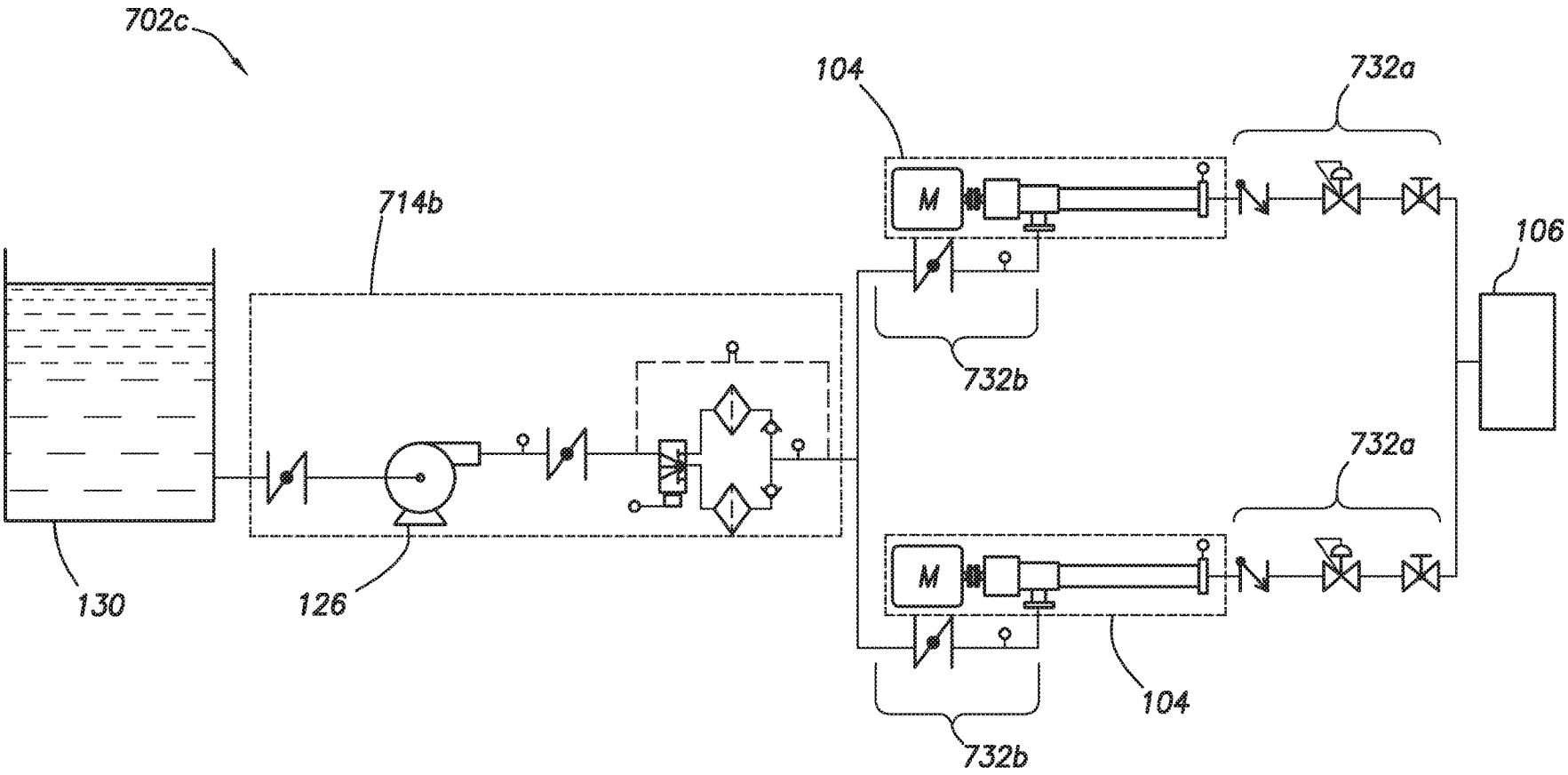
Figure 7D:
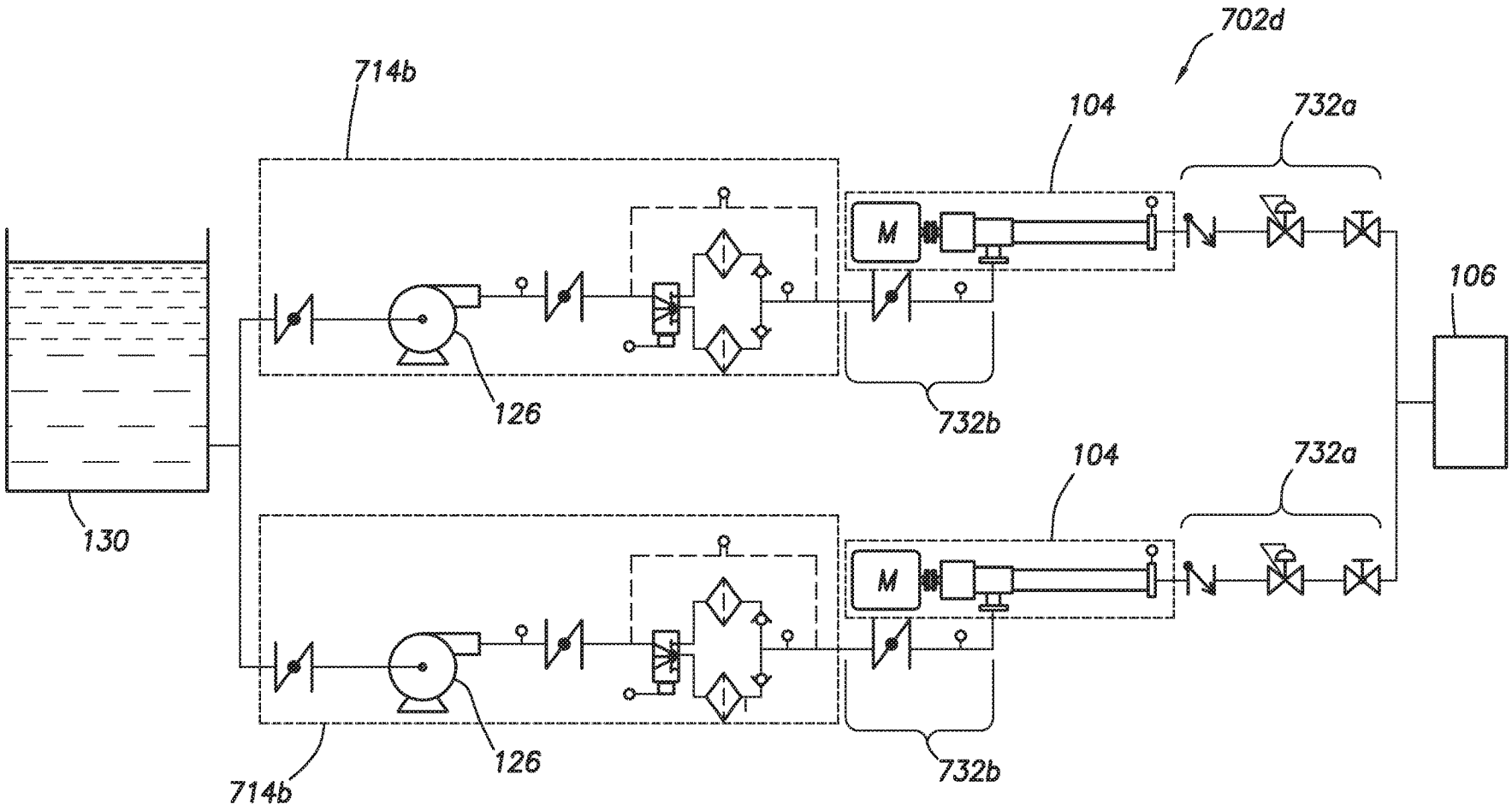

FIGS. 7B-D show the pumping system 702*b* with multiple pumping units 104 in parallel configurations. FIG. 7B shows three pumping units 104 coupled to the fluid unit 714*b* by the connector 732*b* at one end and to the wellsite equipment 106 by the connector 732*a* at another end. The pathways of the connectors 732*a,b* are defined such that each pumping unit 104 is fluidly connected directly via the connectors 732*a,b* to the wellsite equipment 106 and the fluid unit 114, respectively. An expansion joint 733 may optionally be provided along connector 732*b*. An opening along the pumping system 702*b* is provided for including additional pumping units 104 as needed.

FIG. 7C shows a pumping system 702*c* with two pumping units 104 in a parallel configuration. This figure is similar to FIG. 7A, except that two pumping unit 104 are connected to the same fluid unit 714*b* and the wellsite equipment 106. As also shown in this view, the fluid unit 714*b* may have a fluid source 130 external thereto.

FIG. 7D shows a pumping system 702*d* with two pumping units 104 and two fluid units 114 in a parallel configuration. In this version, each of the pumping units 104 is connected to the fluid source 130 by a separate fluid unit 714*b*.

Figure 7E:
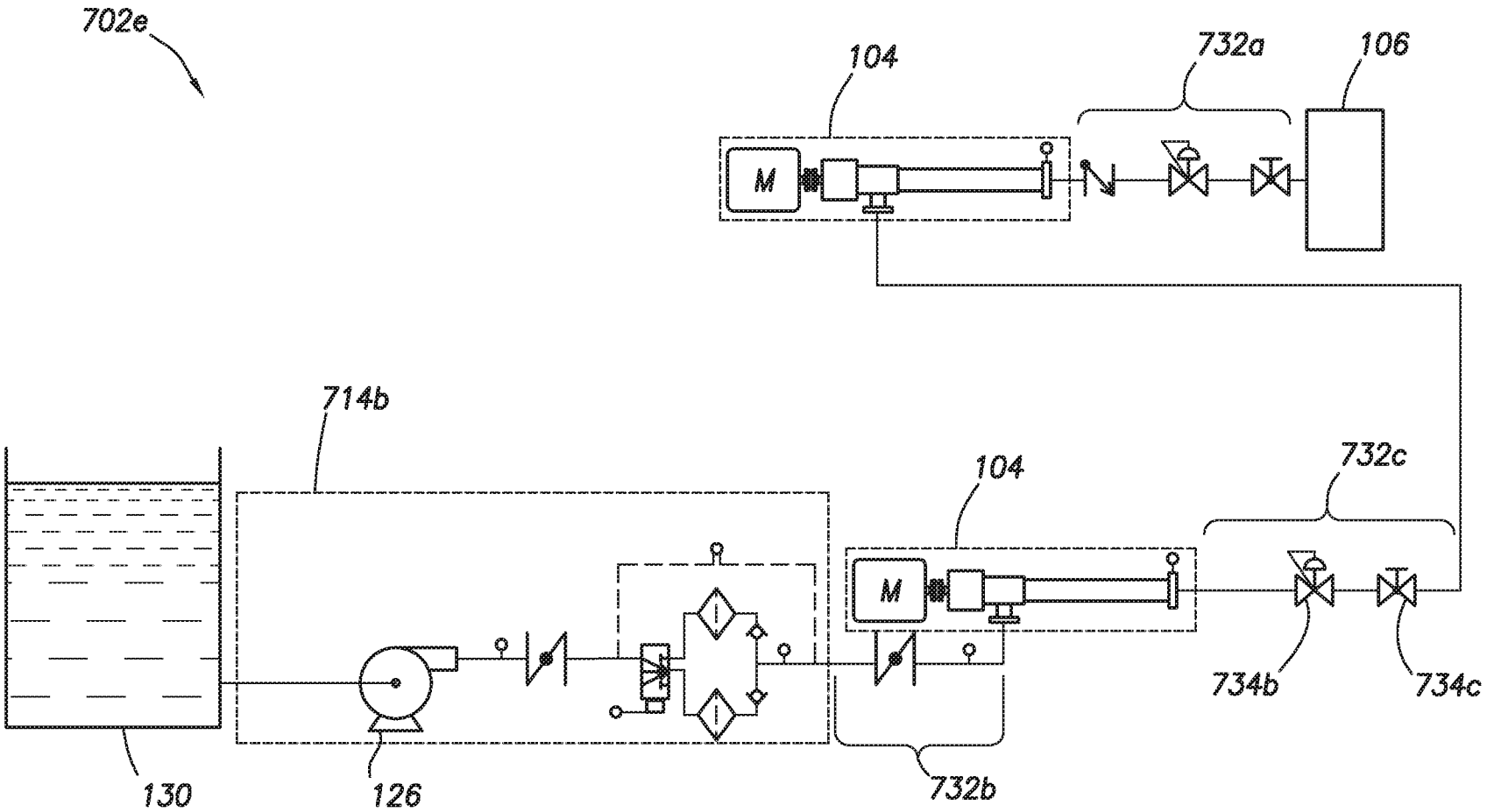

FIG. 7E shows a pumping system 702*e* with two pumping units 104 in a series configuration. This figure is similar to FIG. 7A, except that a first pumping unit 104 is connected by connector 732*a* to the rig 110 at one end and by a connector 732*c* to a second pumping unit 104. The connector 732*c* is depicted as having a choke valve 734*b*, and a globe valve 734*c*. The second pumping unit 104 is connected to the fluid unit 714*b* by connector 732*b*.

Figure 8:
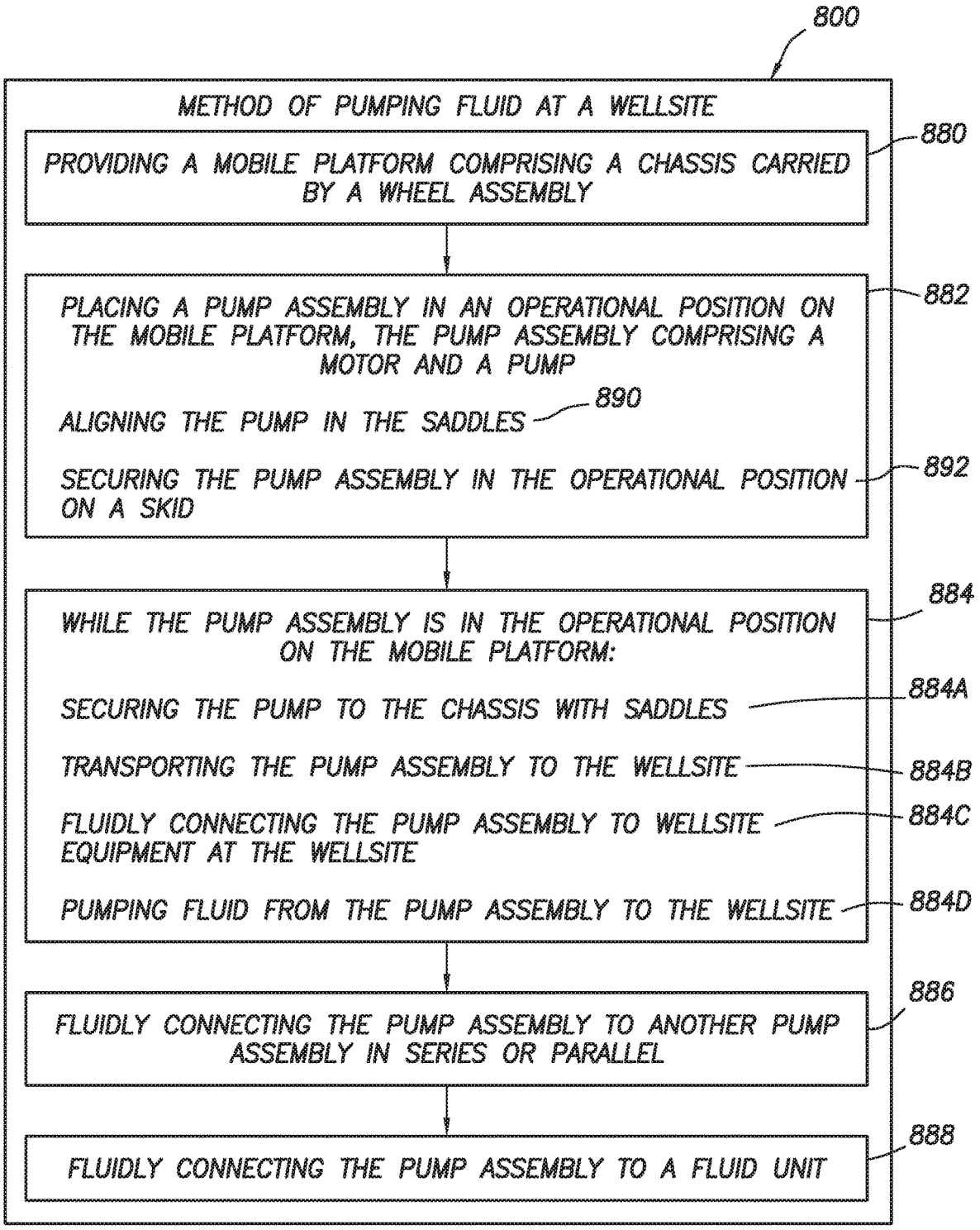
FIG. 8 is a flow chart depicting a method of pumping at a wellsite.

FIG. 8 shows a method 800 of pumping fluid at a wellsite. The method 800 involves 880—providing a mobile platform comprising a chassis carried by a wheel assembly, 882—placing a pump assembly in an operational position on the mobile platform, the pump assembly comprising a motor and a pump, and 884—while the pump assembly is in the operational position on the mobile platform: 884*a*—securing the pump to the chassis with saddles, 884*b*—transporting the pump assembly to the wellsite, 884*c*—fluidly connecting the pump assembly to wellsite equipment at the wellsite, and 884*d*—pumping fluid from the pump assembly to the wellsite.

The method may also involve 886—fluidly connecting the pump assembly to another pump assembly in series or parallel, 888—fluidly connecting the pump assembly to a fluid unit, 890—aligning the pump in the saddles, and 892—securing the pump assembly in the operational position on a skid. Other features may be performed. Portions of the method may be performed in any order, and repeated as needed.

While the embodiments are described with reference to various implementations and exploitations, it will be understood that these embodiments are illustrative and that the scope of the inventive subject matter is not limited to them. Many variations, modifications, additions and improvements are possible. For example, various combinations of one or more of the features and/or methods provided herein may be used.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

For example, while certain connectors are provided herein, it will be appreciated that various forms of connection may be provided.

Insofar as the description above and the accompanying drawings disclose any additional subject matter that is not within the scope of the claim(s) herein, the inventions are not dedicated to the public and the right to file one or more applications to claim such additional invention is reserved. Although a very narrow claim may be presented herein, it should be recognized the scope of this invention is much broader than presented by the claim(s). Broader claims may be submitted in an application that claims the benefit of priority from this application.

What is claimed is:

1. A modular horizontal pumping unit for pumping fluid at a wellsite, the modular horizontal pumping unit comprising:

a pump assembly comprising a motor and a pump;

fluid connectors to fluidly connect the pump assembly to well site equipment to pass fluid therebetween during a pumping operation; and a mobile platform transportable to the wellsite, the mobile platform comprising a chassis and a wheel assembly, the chassis comprising a frame with saddles, the frame having a torque bar extending through the frame to prevent deflection, the frame carried by the wheel assembly, the saddles positioned about the frame to support the pump assembly in an operational position thereon during transport of the pump assembly and during the pumping operation at the wellsite, wherein the frame comprises a pair of beams, the pair of beams connected together by cross braces positioned between the pair of beams, the torque bar positioned between the pair of beams, wherein the torque bar has a longitudinal axis oriented in a longitudinal direction of the chassis, and wherein the torque bar comprises a tube that extends through the cross braces.

2. The modular horizontal pumping unit of claim 1, wherein the saddles comprise a base and a receptacle.

3. The modular horizontal pumping unit of claim 2, wherein the receptacle comprises one of a ring receptacle and an open receptacle.

4. The modular horizontal pumping unit of claim 1, wherein the chassis has saddle plates supported on the frame, the saddles secured to the saddle plates.

5. The modular horizontal pumping unit of claim 1, further comprising an operation station carried by the chassis, the operation station comprising electronics to drive the motor.

6. The modular horizontal pumping unit of claim 5, wherein the operation station comprises a housing with the electronics therein and a control panel coupled to the electronics, the control panel oriented for operator line of sight.

7. The modular horizontal pumping unit of claim 6, wherein the operation station comprises a vertical housing and a support arm, the support arm defining a cover extending between the housing and the mobile platform.

8. The modular horizontal pumping unit of claim 1, wherein the wheel assembly is a modular assembly removably attached to the chassis.

9. The modular horizontal pumping unit of claim 1, further comprising jacks extendable from the chassis to lift the chassis above a ground surface at the wellsite.

10. The modular horizontal pumping unit of claim 1, further comprising a skid removably connectable to the chassis, the pump assembly supported on the chassis by the skid.

11. The modular horizontal pumping unit of claim 1, further comprising at least one additional pump assembly, the pump assembly being connected to the at least one additional pump assembly in series or parallel.

12. The modular horizontal pumping unit of claim 1, wherein the pump assembly further comprises at least one fluid unit comprising a fluid source.

13. The modular horizontal pumping unit of claim 1, wherein the mobile platform comprises a hitch assembly connectable to a vehicle.

14. The modular horizontal pumping unit of claim 1, wherein the fluid connectors comprise at least one valve, filter, restrictor, gauge, diverter, and combinations thereof.

15. The modular horizontal pumping unit of claim 1, wherein the saddles are positioned on the chassis to secure a tubular portion of the pump to the chassis, wherein the tubular portion of the pump has a longitudinal axis oriented in the direction of the longitudinal direction of the chassis, and wherein each of the saddles comprises a base positioned on a surface of the chassis and a receptacle supported by the base, the receptacle shaped to receive and support the tubular portion of the pump a distance above the chassis.

16. The modular horizontal pumping unit of claim 15, wherein the base comprises saddle plates secured to the surface of the chassis.

17. The modular horizontal pumping unit of claim 15, wherein the longitudinal axis of the pump is positioned above the torque bar.

18. The modular horizontal pumping unit of claim 1, wherein the pair of beams has a first end and a second end opposite the first end, wherein a first one of the cross braces is positioned adjacent to the first end and a second one of the cross braces is positioned adjacent to the second end, and wherein the torque bar extends at least from the first one of the cross braces and the second one of the cross braces.

19. A horizontal pumping system for pumping fluid at a wellsite, the horizontal pumping system comprising:

a fluid unit; and modular pumping units fluidly connected together, each of the modular pumping units comprising:

a pump assembly comprising a motor and a pump;

fluid connectors to fluidly connect the pump assembly to wellsite equipment to pass fluid therebetween during a pumping operation; and a mobile platform transportable to the wellsite, the mobile platform comprising a chassis and a wheel assembly, the chassis comprising a frame with saddles, the frame having a torque bar extending through the frame to prevent deflection, the frame carried by the wheel assembly, the saddles positioned about the frame to support the pump assembly in an operational position thereon during transport of the pump assembly and during the pumping operation at the wellsite, wherein the frame comprises a pair of beams, the pair of beams connected together by cross braces positioned between the pair of beams, the torque bar positioned between the pair of beams, wherein the torque bar has a longitudinal axis oriented in a longitudinal direction of the chassis, and wherein the torque bar comprises a tube that extends through the cross braces.

20. The horizontal pumping system of claim 19, wherein the fluid unit comprises a fluid source and a pump.

21. The horizontal pumping system of claim 19, wherein the fluid unit is connectable to a fluid source.

22. The horizontal pumping system of claim 19, wherein the fluid unit is carried by the mobile platform.

23. The horizontal pumping system of claim 19, wherein the fluid unit comprises a pump and a filter.

24. The horizontal pumping system of claim 19, wherein the modular pumping units are connected in series or parallel.

25. The horizontal pumping system of claim 19, further comprising additional fluid connectors connectable between the fluid unit and the modular pumping units.

26. The horizontal pumping system of claim 19, wherein the fluid unit is carried separately from the mobile platform.

27. A method of pumping fluid at a wellsite, the method comprising:

providing a mobile platform comprising a chassis carried by a wheel assembly, the chassis comprising a frame comprising a pair of beams;

preventing deflection of the chassis by securing the pair of beams together with cross braces and positioning a torque bar between the pair of beams, the torque bar having a longitudinal axis oriented in a longitudinal direction of the chassis, the torque bar comprising a tube that extends through the cross braces;

placing a pump assembly in an operational position on the mobile platform, the pump assembly comprising a motor and a pump; and while the pump assembly is in the operational position on the mobile platform, securing the pump to the chassis with saddles;

transporting the pump assembly to the wellsite;

fluidly connecting the pump assembly to wellsite equipment at the wellsite; and pumping fluid from the pump assembly to the wellsite.

28. The method of claim 27, further comprising fluidly connecting the pump assembly to another pump assembly in series or parallel.

29. The method of claim 27, further comprising fluidly connecting the pump assembly to a fluid unit.

30. The method of claim 27, further comprising aligning the pump in the saddles.

31. The method of claim 27, further comprising securing the pump assembly in the operational position on a skid.

* * * * *